US006951834B2

(12) United States Patent
Mitra et al.

(10) Patent No.: US 6,951,834 B2
(45) Date of Patent: Oct. 4, 2005

(54) BACTERICIDAL CLEANING WIPE COMPRISING A BIGUANIDE DISINFECTANT

(75) Inventors: Shuman Mitra, Dublin, CA (US); Richard E. Simon, Tracy, CA (US); Wayne B. Scott, Walnut Creek, CA (US); Kenneth L. Vieira, Livermore, CA (US); Glen A. Shaffer, Loveland, CO (US); Andrew Kilkenny, Pleasanton, CA (US)

(73) Assignee: The Clorox Corporation, Oakland, CA (US)

( * ) Notice: Subject to any disclaimer, the term of this patent is extended or adjusted under 35 U.S.C. 154(b) by 181 days.

(21) Appl. No.: 10/840,699

(22) Filed: May 6, 2004

(65) Prior Publication Data

US 2004/0209792 A1 Oct. 21, 2004

Related U.S. Application Data

(62) Division of application No. 10/461,034, filed on Jun. 13, 2003, which is a continuation of application No. 09/939,179, filed on Aug. 24, 2001, now abandoned, which is a continuation of application No. 09/737,641, filed on Dec. 14, 2000, now abandoned.

(51) Int. Cl.[7] ..... C11D 3/48

(52) U.S. Cl. ..... 510/295; 510/382; 510/383; 510/432; 510/477; 510/480

(58) Field of Search ..... 510/295, 382, 510/383, 432, 477, 480

(56) References Cited

U.S. PATENT DOCUMENTS 4,421,665 A * 12/1983 Lloyd et al. ..... 510/112
4,455,250 A 6/1984 Frazier
4,540,505 A 9/1985 Frazier
4,725,489 A 2/1988 Jones et al.
4,748,158 A 5/1988 Biermann et al.
4,923,685 A 5/1990 Wuelknitz et al.
5,141,803 A 8/1992 Pregozen
5,330,675 A 7/1994 Kroner et al.
5,403,505 A 4/1995 Hachmann et al.
5,405,878 A 4/1995 Ellis et al.
5,529,713 A 6/1996 Gauthier-Fournier
5,576,284 A 11/1996 van Buskirk et al.
5,719,113 A 2/1998 Fendler et al.
5,739,168 A 4/1998 Hioki et al.
5,962,399 A 10/1999 Wulff et al.
6,013,615 A 1/2000 Zhou et al.
6,045,817 A 4/2000 Ananthapadmanabhan et al.
6,066,674 A 5/2000 Hioki et al.
6,080,387 A 6/2000 Zhou et al.
6,083,517 A 7/2000 Ananthapadmanabhan et al.
6,090,771 A 7/2000 Burt et al.
6,126,931 A 10/2000 Sawan et al.
6,184,195 B1 2/2001 Cheung et al.
6,255,270 B1 7/2001 Barger et al.
6,294,186 B1 9/2001 Beerse et al.
6,353,022 B1 3/2002 Schneider et al.

FOREIGN PATENT DOCUMENTS

WO WO/09642 2/2000
WO WO/23510 A2 4/2001
WO WO/23511 A1 4/2001

* cited by examiner

*Primary Examiner*—Charles Boyer
(74) *Attorney, Agent, or Firm*—Fay Sharpe Fagan Minnich & McKee; Robert V. Vickers; Brian E. Turung

(57) ABSTRACT

An improved cleaning composition loaded on a cleaning wipe having improved biocidal release from the cleaning wipe. The improved cleaning composition includes a cationic biocide and a biocide release agent.

60 Claims, 2 Drawing Sheets

BACTERICIDAL CLEANING WIPE COMPRISING A BIGUANIDE DISINFECTANT

The present invention is a division of U.S. patent application Ser. No. 10/461,034 filed Jun. 13, 2003, currently pending, which is a continuaton of U.S. patent application Ser. No. 09/939,179 filed Aug. 24, 2001, abandoned, which is a continuation in part of U.S. patent application Ser. No. 09/737,641 filed Dec. 14, 2000, abandoned, entitled "Bactericidal Cleaning Wipe", and is incorporated herein by reference.

The present invention relates to an improved general purpose cleaning wipe which includes a wipe combined with a liquid cleaning composition having a biocide and a biocide release agent. The cleaning wipe includes a wipe combined with a cleaning composition having a biocide. Although the invention is principally directed to a cleaning wipe, the invention has broader applications and includes an improved cleaning composition comprising a biocide that can be used alone or in combination with a towel, cloth, rag, sponge, mop, squeegee, and the like.

BACKGROUND OF THE INVENTION

Cleaning wipes have long been used for a variety of purposes. Such cleaning wipes have contained various compounds to accomplish their intended purpose. For example, cleaning wipes have included inverse emulsions (i.e. water-in-liquid) to clean infants. Cleaning wipes have also included waxes to polish and clean furniture. Cleaning wipes have further included soaps and detergents to clean an individual's hands, counter tops, floors, and the like. Cleaning wipes have also included ammonia to clean glass surfaces. Alcohol and various other biocides have been included on cleaning wipes to disinfect a variety of surfaces.

One type of biocide that has been used in cleaning wipes is quaternary ammonium salts commonly referred to as quats. Liquid cleaners applied to cleaning wipes typically include relatively large amounts of quat. It has been observed that only about 50% of the quat on a cleaning wipe is released from the wipe when the wipe is applied to a surface. As a result, added quat is included in the liquid cleaner to ensure that the desired amount of quat transfers to the cleaned surface. Although quats are excellent biocides, quats can cause skin irritation when used in too high of concentrations. Furthermore, liquid cleaners having a high quat content are subject to various local, state and/or federal regulations due to the toxicity of the quat in high concentrations. In addition to the regulatory and skin irritation concerns associated with quats, quats are typically the highest cost component of the cleaner, thus larger quat concentrations translate into higher product costs.

There have been various attempts to develop liquid cleaners having improved quat release from the cleaning wipes. Some cleaning formulations use a high weight percentage of isopropyl alcohol to promote quat release from the cleaning wipe. It has been observed that isopropyl alcohol in amounts of over about 12% can improve the quat release from the wipe. The use of isopropyl alcohol is also beneficial in that the alcohol has its own antimicrobial properties and cost substantially less than quats. Although the use of isopropyl alcohol in the cleaning formulation improves quat release from the wipe, a substantial amount of quat still remains on the cleaning wipe after use. In addition, local, state and/or federal governments have begun to promulgate regulations on the amount of isopropyl alcohol that can be used in cleaners. Indeed, in California, regulations have been proposed to regulate the use of cleaners containing over 4–5 weight percent isopropyl alcohol. As a result, cleaners having high concentrations of isopropyl alcohol may be less preferred.

The present inventors have also attempted to use different types of biocides to over come the problems associated to quat release. One such biocide has been biguanide compounds. These biguanide compounds have been used in combination with quats and as a substitute for the quats. These trials have revealed that similar problems occur when biguanide compounds are used alone or in combination with quats. The biguanide or biguanide-quat tends to be retained on the wipe thus requiring higher concentrations of the biocide in the cleaning formulation to ensure that a sufficient amount of biocide is transferred to a surface to be cleaned.

In view of the present state of the art of cleaning wipes containing quats and/or biguanides, there is a demand for a quat and/or biguanide containing cleaner that can be applied to and/or used with an absorbent/adsorbent material, and which is formulated to have improved quat and/or biguanide release without having to incorporate high weight percentages of isopropyl alcohol or any other type of alcohol to promote such release.

SUMMARY OF THE INVENTION

The present invention is directed to an improved cleaning wipe impregnated with an improved cleaning composition that includes a biocide and a biocide release agent. The improved cleaning composition is generally a liquid cleaner; however, the improved cleaning composition may be in an aerosol, solid or semi-solid form. The improved cleaning composition can be used by itself or combined with other cleaning formulations. The improved cleaning composition is generally applied to a cleaning wipe and loaded onto the cleaning wipe to a desired loading ratio; however, the improved cleaning composition can be used separately from a cleaning wipe. For instance, the improved cleaning composition can be packaged to be used alone or in combination with other cleaners and/or absorbent or adsorbent materials. The improved cleaning composition is typically formulated to clean hard surface counter tops; however, the improved cleaning composition has much broader applications and be used as a clean glass cleaner, appliance cleaner, hard surface cleaner, floor cleaner, dishwashing cleaner, and the like. As used herein, the term "hard surface" includes, but is not limited to, bathroom surfaces (e.g., floor, tub, shower, mirror, toilet, bidet, bathroom fixtures), kitchen surfaces (e.g., counter tops, stove, oven, range, sink, refrigerator, microwave, appliances, tables, chairs, cabinets, drawers, floor), furniture surfaces (e.g., tables, chairs, entertainment centers, libraries, cabinets, desks, doors, shelves, couches, beds, t.v., stereo, pool table, ping pong table), windows, window ledges, tools, utility devices (e.g., telephones, radios, CD players, digital sound devices, palm computers, laptop computers), toys, writing implements, watches, framed pictures or paintings, books). The improved cleaning composition can also be used a variety of industrial and institutional applications. As used herein, the terms "industrial" and "institutional" shall mean the fields of use which include, but are not limited to, contract (professional) cleaning and disinfecting, retail facilities cleaning and disinfecting, industrial/manufacturing facilities cleaning and disinfecting, office cleaning and disinfecting services, hotel/restaurant/entertainment cleaning and disinfecting, health care (e.g., hospitals, urgent care facilities, clinics, nursing homes, medical/dental offices, laboratories) facilities cleaning and disinfecting, educational facilities cleaning and disinfecting, recreational (e.g., arenas, coliseums, resorts, halls, stadiums, cruise lines, arcades, convention centers, museums, theaters, clubs, family entertainment complexes (indoor and/or outdoor), marinas, parks) facilities cleaning and disinfecting, food service facilities cleaning and disinfecting, governmental facilities cleaning and disinfecting, public transportation facilities (e.g., airports, airlines, cabs, buses, trains, subways, boats, ports, and their associated properties) cleaning and disinfecting. The improved cleaning composition can be in concentrated form or unconcentrated for (e.g. ready to use form). When the improved cleaning composition is not first impregnated on a wipe or other absorbent or adsorbent material, the improved cleaning composition can be dispensed in cleaning form from a container, from an aerosol container, or from a container as a crystal, powdered or otherwise semi-solid or solid form. The improved cleaning composition can be used as a disinfectant, sanitizer, and/or sterilizer. As used herein, the term "disinfect" shall mean the elimination of many or all pathogenic microorganisms on surfaces with the exception of bacterial endospores. As used herein, the term "sanitize" shall mean the reduction of contaminants in the inanimate environment to levels considered safe according to public health ordinance, or that reduces the bacterial population by significant numbers where public health requirements have not been established. An at least 99% reduction in bacterial population within a 24 hour time period is deemed "significant." As used herein, the term "sterilize" shall mean the complete elimination or destruction of all forms of microbial life and which is authorized under the applicable regulatory laws to make legal claims as a "Sterilant" or to have sterilizing properties or qualities.

In one aspect of the present invention, the cleaning wipe is at least partially impregnated with the improved cleaning composition. The cleaning wipe that is at least partially impregnated with the improved cleaning composition. When the improved cleaning composition is loaded or impregnated onto a cleaning wipe, the improved cleaning composition is formulated to have a viscosity that allows such loading. Typically, the viscosity of the improved cleaning composition is less than about 1,000 centipoise ("cps") when the improved cleaning composition is loaded or impregnated onto a cleaning wipe. The viscosity of the improved cleaning composition can be greater than 1000 cps when the improved cleaning composition is used separately from a cleaning wipe.

In another aspect of the present invention, the dry cleaning wipe onto which the improved cleaning composition is loaded generally includes an absorbent and/or adsorbent material. In one embodiment, the cleaning wipe includes, but is not limited to, a nonwoven material. In one aspect of this embodiment, the nonwoven material includes, but is not limited to, nonwoven, fibrous sheet materials. In another aspect of this embodiment, the nonwoven material includes, but is not limited to, meltblown, coform, air-laid, spun bond, wet laid, bonded-carded web materials, and/or hydroentangled (also known as spunlaced) materials. In another embodiment, the cleaning wipe includes woven materials. In one aspect of this embodiment, the woven material includes, but is not limited to, cotton fibers, cotton/nylon blends and/or other textiles. In yet another embodiment, the cleaning wipe includes a sponge and/or sponge-like material. In one aspect of this embodiment, the sponge and/or sponge-like material includes, but is not limited to, regenerated cellulose and/or polyurethane foams. In still another embodiment, the cleaning wipe includes, but is not limited to, wood pulp, a blend of wood pulp, and/or synthetic fibers. In one aspect of this embodiment, the synthetic fibers include, but are not limited to, polyester, rayon, nylon, polypropylene, polyethylene, and/or cellulose polymers. In still another embodiment, the cleaning wipe includes a binder. In a further embodiment, the liquid loading capacity of the cleaning wipe is sufficient to retain the desired amount of improved cleaning composition on the cleaning wipe. In one aspect of this embodiment, the liquid loading capacity of the cleaning wipe is at least about 10% of the dry weight of the cleaning wipe. In another aspect of this embodiment, the liquid loading capacity of the cleaning wipe is about 50%–1000% of the dry weight of the cleaning wipe. This loading capacity is expressed as loading ½ to 10 times the weight (or, more accurately, the mass) of the dry cleaning wipe. In still another aspect of this embodiment, the liquid loading capacity of the cleaning wipe is about 200%–800% of the dry weight of the cleaning wipe. In yet another aspect of this embodiment, the liquid loading capacity of the cleaning wipe is about 250%–500% of the dry weight of the cleaning wipe. In still yet another aspect of this embodiment, the liquid loading capacity of the cleaning wipe is about 300%–450% of the dry weight of the cleaning wipe. In still a further embodiment, the improved cleaning composition is impregnated, dosed, loaded, metered, or otherwise dispensed onto the cleaning wipe. The loading of the cleaning wipe can be accomplished in several ways including, but not limited to, treating each individual wipe with a discrete amount of improved cleaning composition, mass treating a continuous web of cleaning wipes with the improved cleaning composition, soaking the entire web of cleaning wipes in the improved cleaning composition, spraying the improved cleaning composition in a stationary or moving web of cleaning wipes, and/or impregnating a stack of individually cut and sized cleaning wipes in a container or a dispenser. In yet a further embodiment, the cleaning wipe has a density of about 0.01–1,000 grams per square meter (referred to as "basis weight"). In one aspect of this embodiment, the cleaning wipe has a density of about 25–120 grams/$m^2$. In still yet a further embodiment, the cleaning wipe is produced as a sheet or web which is cut, die-cut or otherwise sized into the desired appropriate shape and size. In another embodiment, the cleaning wipe has a wet tensile strength of about 25–250 Newton/m. In one aspect of this embodiment, the cleaning wipe has a wet tensile strength of about 75–170 Newton/m. Manufacturers of cleaning wipes that can be used in the present invention include, but are not limited to, Kimberly-Clark, E.I. Du Pont de Nemours and Company, Dexter, American Nonwovens, James River, BBA Nonwoven, and PGI. Specific, nonlimiting examples of cleaning wipes from these manufacturers are disclosed in Bouchette et al., U.S. Pat. Nos. 4,781,974 and 4,615,937; Clark et al, U.S. Pat. No. 4,666,621; Amundson et al., WO 98/03713; Cabell et al., U.S. Pat. No. 5,908,707; Mackey et al., WO 97/40814; Mackey et al.; WO 96/14835; and Moore, EP 750063, all of which are incorporated herein by reference.

In another aspect of the present invention, the cleaning wipe is individually sealed with a heat-sealable and/or glueable thermoplastic overwrap (such as, but not limited to, polyethylene, Mylar and the like). In one embodiment, the cleaning wipes are packaged as numerous, individual sheets which are impregnated with the improved cleaning composition of the present invention. In another embodiment, the cleaning wipes are formed as a continuous web during the manufacturing process and loaded into a dispenser, such as a canister with a closure or a tub with closure. The closure is used to seal the loaded cleaning wipes from the external environment and prevents premature volatilization of the components of the improved cleaning composition. In one aspect of this embodiment, the dispenser includes a plastic such as, but not limited to, high density polyethylene, polypropylene, polycarbonate, polyethylene pterethalate (PET), polyvinyl chloride (PVC), and/or other rigid plastic. In another aspect of this embodiment, the continuous web of cleaning wipes is threaded through an opening in the top of the dispenser. In still another aspect of this embodiment, the dispenser includes a severing arrangement to cut a portion of the cleaning wipe after being removed from the dispenser. The severing arrangement can include, but is not limited to, a knife blade, serrated edge or the like. In still yet another aspect of this embodiment, the continuous web of cleaning wipes is scored, folded, segmented, and/or partially cut into uniform or non-uniform sizes and/or lengths. In a further aspect of this embodiment, the cleaning wipes are interleaved so that the removal of one cleaning wipe advances the next in the opening of the dispenser.

In another aspect of the present invention, the improved cleaning composition is at least partially loaded onto an absorbent and/or adsorbent material prior to cleaning. The absorbent and/or adsorbent material can include the cleaning wipe described above, or include sponges (cellulose, synthetic, etc.), paper towels, napkins, cloths, towels or rags, mop heads, and the like. In such applications, the improved cleaning composition is not preloaded onto an absorbent and/or adsorbent material, but instead applied by the user just prior to and/or during the cleaning process. When the improved cleaning composition is used in such application, the improved cleaning composition is typically packaged in a separate container or receptacle from the absorbent and/or adsorbent material. During the cleaning process, the improved cleaning composition is applied directly to the absorbent and/or adsorbent material and then applied to a surface to be cleaned. The improved cleaning composition can be applied automatically and/or manually to the absorbent and/or adsorbent material.

In yet another aspect of the present invention, the improved cleaning composition is applied to a surface to be cleaned prior to exposing the improved cleaning composition to an absorbent and/or adsorbent material. The absorbent and/or adsorbent material can include the cleaning wipes described above, or include sponges (cellulose, synthetic, etc.), paper towels, napkins, cloths, towels, rags, mop heads, and the like. In such applications, the improved cleaning composition is not preloaded onto an absorbent and/or adsorbent material, but instead applied by the user to a surface to be cleaned and then wiped up by the absorbent and/or adsorbent material. As can be appreciated, the absorbent and/or adsorbent material can include some improved cleaning composition prior to wiping the surface on which the improved cleaning composition is preapplied.

In another aspect of the present invention, the improved cleaning composition is applied or added to a surface or environment to be cleaned without ever applying the cleaning composition to an absorbent and/or adsorbent material. Examples of such uses of the improved cleaning composition include, but are not limited to, dishwasher cleaners, washing machine cleaners, air fresheners, hand lotions/cleaners, cleaners for cleaning internal components of machinery and/or process lines, carpet fresheners, carpet cleaners, cat litter, drain cleaners, toilet cleaners, and the like.

In still another aspect of the present invention, the improved cleaning composition includes an effective amount of biocide to obtain the desired disinfecting, sanitizing, and/or sterilizing qualities of the improved cleaning composition. The improved cleaning composition includes one or more biocides to achieve the desired disinfecting, sanitizing, and/or sterilizing qualities of the improved cleaning composition. The improved cleaning composition is typically formulated to partially or completely kill microorganisms such as, but not limited to, bacteria, fungi, molds, mildew, and/or viruses. The antimicrobial efficacy of the improved cleaning composition can be tailored for a particular household and industrial and/or institutional application, or can be formulated to disinfect sanitize, and/or sterilize surfaces in household and industrial and/or institutional environments. In one embodiment, the improved cleaning composition includes a cationic biocide such as, but not limited to quats and/or biguanides.

In still yet another aspect of the present invention, the improved cleaning composition includes a cationic biocide that includes one or more biguanide compounds. Biguanide compounds are capable of imparting a broad spectrum antimicrobial or germicidal properties to the improved cleaning composition. In one aspect of this embodiment, the one or more biguanide compounds that can be included in the improved cleaning composition include, but are not limited to, compounds having the following general formula:

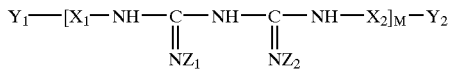

where $X_1$ and $X_2$ are hydrogen or any aliphatic, cycloaliphatic, aromatic, substituted aliphatic, substituted aromatic, heteroaliphatic, heterocyclic, or heteroaromatic compound, or a mixture of any of these. $Y_1$ and $Y_2$ are any aliphatic, cycloaliphatic, aromatic, substituted aliphatic, substituted aromatic, heteroaliphatic, heterocyclic, or heteroaromatic compound, or a mixture of any of these. M is an number equal to or greater than 1. Typically, M has an average value such that the molecular weight biguanide compounds is about 1000–1400; however, the molecular can be higher or lower. Generally, M is about 2–20. $Z_1$ and $Z_2$ are hydrogen or a hydrogen bonded to a salt. The above-mentioned organic materials may be modified to include a thiol group in their structure so as to allow for the bonding of the compound to a metallic substrate, or may be derivatized with other functional groups to permit direct immobilization on a non-metallic substrate. The above-mentioned organic materials may also be suitably functionalized to incorporate groups such as hydroxy, amine, halogen, epoxy, alkyl or alkoxy silyl functionalities to enable direct immobilization to a surface. The salt can include salts with an inorganic acid, such as hydrochloride, hydrofluoride, nitrate, sulfate and/or phosphate, and/or salts with an organic acid, such as carboxylic acid, acetate, benzoate, tartrate, adipate, lactate, formate, maleate, glutamate, ascorbate, citrate, gluconate, oxalate, succinate, pamoate, salicylate, isethionate, succinamate, mono-diglycollate, dimethanesulfonate, di-isobutyrate, and/or glucoheptonate. Specific examples of these compounds include, but are not limited to, polyhexamethylene biguanide hydrochloride, p-chlorophenyl biguanide; and 4-chlorobenzhydryl biguanide. In another aspect of this embodiment, the biguanide compounds include, but are not limited to, halogenated hexidine such as, but not limited to, chlorhexidine (1,1'-hexamethylene-bis-5-(4-chlorophenyl biguanide) and its salts. The salts include salts with an inorganic acid, such as hydrochloride, hydrofluoride, nitrate, sulfate and/or phosphate, and/or salts with an organic acid, such as carboxylic acid, acetate, benzoate, tartrate, adipate, lactate, formate, maleate, glutamate, ascorbate, citrate, gluconate, oxalate, succinate, pamoate, salicylate, isethionate, succinamate, mono-diglycollate, dimethanesulfonate, di-isobutyrate, and/or glucoheptonate. Examples of salts of chlorhexidine include, but are not limited to, chlorhexidine diphosphanilate, chlorhexidine digluconate, chlorhexidine diacetate, chlorhexidine dihydrochloride, chlorhexidine dichloride, chlorhexidine gluconate, chlorhexidine dihydroiodide, chlorhexidine diperchlorate, chlorhexidine dinitrate, chlorhexidine sulfate, chlorhexidine sulfite, chlorhexidine thiosulfate, chlorhexidine di-acid phosphate, chlorhexidine difluorophosphate, chlorhexidine diformate, chlorhexidine dipropionate, chlorhexidine di-iodobutyrate, chlorhexidine di-n-valerate, chlorhexidine dicaproate, chlorhexidine malonate, chlorhexidine succinate, chlorhexidine malate, chlorhexidine tartrate, chlorhexidine dimonoglycolate, chlorhexidine monodiglycolate, chlorhexidine dilactate, chlorhexidine di-alpha-hydroxyisobutyrate, chlorhexidine diglucoheptonate, chlorhexidine di-isothionate, chlorhexidine dibenzoate, chlorhexidine dicinnamate, chlorhexidine dimandelate, chlorhexidine di-isophthalate, chlorhexidine di-2-hydroxynapthoate, and chlorhexidine embonate. Additional examples of biguanide compounds which can be used are disclosed in U.S. Pat. Nos. 2,684,924; 2,990,425; 3,468,898; 4,022,834; 4,053,636; 4,198,392; 6,143,244; 6,143,281; and 6,153,568; EPC24,031; and DE1,964,196; DE2,212,259; and DE2,627,548, which are incorporated herein by reference. In another embodiment, the biguanide compound content of the improved cleaning composition is greater than about 0.02 weight percent of the improved cleaning composition when the biguanide compound functions as the primary biocide in the improved cleaning composition. As can be appreciated, when other biocides are included with the biguanide compound in the improved cleaning composition, the biguanide compound content can be lower than about 0.02 weight percent of the improved cleaning composition. A biguanide compound content of lower than about 0.02 weight percent, when the biguanide compound functions as the primary biocide in the improved cleaning composition, may not eliminate a majority of common microorganisms (e.g. bacteria, viruses) when exposed to the improved cleaning composition. A biguanide compound content of at least about 0.02 weight percent and greater has been found to eliminate a majority, if not all, of the common microorganisms that come in contact with the improved cleaning composition. The upper limit of the biguanide compound content of the improved cleaning composition can be significantly greater than about 0.02 weight percent; however, the biguanide compound content is typically limited by economic cost considerations, local, state and/or federal regulatory restrictions, formula solubility requirements, streaking and residue properties of the improved cleaning composition, skin irritation considerations, and/or the intended use of the improved cleaning composition. Typically, the biguanide compound content of the improved cleaning composition is no more than about 5 weight percent. A biguanide compound content that exceeds about 5 weight percent generally results in the final product having a prohibitive cost since the biguanide compound is typically one of the higher costing component of the improved cleaning composition. In addition, a biguanide compound content exceeding about 5 weight percent may be subject to strict local, state and/or federal regulations due to the toxicity of the improved cleaning composition. However, absent the cost and regulatory barriers, the biguanide compound content can exceed about 5 weight percent when the improved cleaning composition is used in applications which require a high biguanide compound content. In this respect, the biguanide compound content can be up to or exceed about 20 weight percent. The concentration of the biguanide compound in the improved cleaning composition may also exceed about 5 weight percent when the improved cleaning composition is in a concentrated form, thus intended to be diluted prior to use. In one aspect of this embodiment, the biguanide compound content of the improved cleaning composition is about 0.05–5 weight percent. In another aspect of this embodiment, the biguanide compound content of the improved cleaning composition is about 0.08–5 weight percent. In still another aspect of this embodiment, the biguanide compound content of the improved cleaning composition is about 0.1–2 weight percent In yet another aspect of this embodiment, the biguanide compound content of the improved cleaning composition is about 0.1–1 weight percent. In still yet another aspect of this embodiment, the biguanide compound content of the improved cleaning composition is about 0.15–0.8 weight percent. In a further aspect of this embodiment, the biguanide compound content of the improved cleaning composition is about 0.175–0.6 weight percent. In yet a further aspect of this embodiment, the biguanide compound content of the improved cleaning composition is about 0.2–0.5 weight percent. In still a further aspect of this embodiment, the biguanide compound content of the improved cleaning composition is about 0.25–0.4 weight percent.

In yet another aspect of the present invention, the improved cleaning composition includes an effective amount of a cationic biocide other than or in combination with one or more biguanide compounds to obtain the desired disinfecting, sanitizing and/or sterilizing qualities of the improved cleaning composition. In one embodiment, the improved cleaning composition includes one or more quaternary ammonium compounds (quats). Similar to biguanide compounds, quats are also capable of imparting a broad spectrum antimicrobial or germicidal properties to the improved cleaning composition. The general structure for the one or more quats that can be included in the improved cleaning composition is:

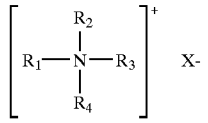

wherein X is an anion such as a halide, acetate, nitrite, a lower alkosulfate, carbonate and/or an alkyl carboxylate; and $R_1$–$R_4$ are straight chain, branched chain and/or cyclic chain groups. In one aspect of this embodiment, one or more of the quats included in the improved cleaning composition have at least one higher molecular weight group and at least one lower molecular weight group linked to a common, positively charged nitrogen atom. The one or more higher molecular weight groups include, but are not limited to, higher alkyl groups containing about 6–30 carbon atoms that are branched, unbranched, saturated and/or unsaturated. The one or more lower molecular weight groups include, but are not limited to, 1–12 carbon atoms that are branched, unbranched, saturated, and/or unsaturated. Specific lower molecular weight substituents include, but are not limited to, alkyls of 1 to 4 carbon atoms (e.g. methyl and ethyl), alkyl ethers, hydroxyalkyls, and/or benzyls. One or more of the higher and/or lower molecular weight substituents may include, or may be replaced by, an aryl moiety. Specific aryl moieties include, but are not limited to, benzyl, ethyl benzyl and/or phenyl. In another aspect of this embodiment, an electrically balancing anion (counterion) is linked to the positively charged nitrogen atom. Specific anions include, but are not limited to, bromide, sulfate, iodide, alkycarboxylate, methosulfate, ethosulfate, phosphate, carboxylic acid, or chloride. In still another aspect of this embodiment, specific quats that can be used in the cleaning formulation include, but are not limited to, alkyl ammonium halides such as lauryl trimethyl ammonium chloride and dilauryl dimethyl ammonium chloride; alkyl aryl ammonium halides such as octadecyl dimethyl benzyl ammonium bromide; ethyl dimethyl stearyl ammonium chloride, trimethyl stearyl ammonium chloride, trimethyl cetyl ammonium chloride, dimethyl ethyl lauryl ammonium chloride, dimethyl propyl myristyl ammonium chloride, dinonyl dimethyl ammonium chloride, didecyl dimethyl ammonium chloride, diundecyl dimethyl ammonium chloride, didecyl dimethyl ammonium chloride, dinonyly ethyl ammonium chloride, dimethyl ethyl benzyl ammonium chloride, 3-(trimethyxyosilyl) propyldidecylmethyl ammonium chloride, 3-(trimethoxysilyl) propyloctadecycdimethyl ammonium chloride, dimethyl dioctyl ammonium chloride, didecyl dimethyl ammonium chloride, didodecyl dimethyl ammonium chloride, dimethyl ditetradecyl ammonium chloride, dihexadecyl dimethyl ammonium chloride, dimethyl dioctadecyl ammonium chloride, decyl dimethyl octyl ammonium chloride, dimethyl dodecyloctyl ammonium chloride, benzyl decyl dimethyl ammonium chloride, benzyl dimethyl dodecyl ammonium chloride, benzyl dimethyl tetradecyl ammonium chloride, decyl dimethyl (ethyl benzyl) ammonium chloride, decyl dimethyl (dimethyl benzyl)-ammonium chloride, (chlorobenzyl)-decyl dimethyl ammonium chloride, decyl-(dichlorobenzyl)-dimethyl ammonium chloride, benzyl didecyl methyl ammonium chloride, benzyl didocyl methyl ammonium chloride, benzyl ditetradecyl methyl ammonium chloride, benzyl dodecyl ethyl methyl ammonium chloride, and the like. Some examples of commercially available quats include didecyl dimethyl ammonium chloride, available as BTC 1010 from Stepan Chemical Co.; BARDAC 2250 from Lonza, Inc.; FMB 210-15 from Huntington; Maquat 4450-E from Mason; dialkyl dimethyl ammonium chloride, available as BTC 818 from BARDAC 2050, Inc.; FMB 302 and Maquat 40 from Mason; and/or alkyl dimethyl benzyl ammonium chloride available as BTC 835 and BARQUAT MB-50 from Lonza, Inc.; and FMB 451-5 and MC 1412 from Mason. Some quats are sold as mixtures of two or more different quats. Examples of these commercially available quat mixtures include, but are not limited to, twin chain blend/alkyl benzyl ammonium chloride compounds available as BARDAC®205M, BARDAC®208M, BARQUAT 4250, and BARQUAT 4250Z from Lonza, Inc.; as BTC 885, BTC 888 and BTC 2250 from Stepan Chemical Co.; as FMB 504 and FMB 504-8 from Huntington; and as MQ 615M and MQ 624M from Mason. In another embodiment, the quat content of the improved cleaning composition is greater than about 0.04 weight percent of the improved cleaning composition when the quat functions as the primary biocide in the improved cleaning composition. As can be appreciated, when other biocides are included with the quat in the improved cleaning composition, the quat content can be lower than about 0.04 weight percent of the improved cleaning composition. A quat content of lower than about 0.04 weight percent, when the quat functions as the primary biocide in the improved cleaning composition, may not eliminate a majority of common microorganisms when exposed to the improved cleaning composition. A quat content of about 0.04 weight percent and greater has been found to eliminate a majority, if not all, of the common microorganisms that come in contact with the improved cleaning composition. The upper limit to the quat content of the improved cleaning composition can be significantly greater than about 0.04 weight percent; however, the quat content is typically limited by economic cost considerations, local, state and/or federal regulatory restrictions, formula solubility requirements, streaking properties of the improved cleaning composition, skin irritation considerations, and/or the intended use of the improved cleaning composition. Typically, the quat content of the improved cleaning composition is no more than about 5 weight percent. A quat content that exceeds about 5 weight percent generally results in the final product having a prohibitive cost since the quat is typically one of the higher costing components of the improved cleaning composition. In addition, a quat content exceeding about 5 weight percent may be subject to strict local, state and/or federal regulations due to the toxicity of the improved cleaning composition. However, absent the cost and regulatory barriers, the quat content can exceed about 5 weight percent when the improved cleaning composition is used in applications which require a high quat content. The concentration of the quat in the improved cleaning composition may also exceed about 5 weight percent when the improved cleaning composition is in a concentrated form, thus intended to be diluted prior to use. In one aspect of this embodiment, the quat content of the improved cleaning composition is about 0.05–5 weight percent. In another aspect of this embodiment, the quat content of the improved cleaning composition is about 0.08–5 weight percent. In still another aspect of this embodiment, the quat content of the improved cleaning composition is about 0.1–2 weight percent. In yet another aspect of this embodiment, the quat content of the improved cleaning composition is about 0.1–1 weight percent. In still yet another aspect of this embodiment, the quat content of the improved cleaning composition is about 0.15–0.8 weight percent. In a further aspect of this embodiment, the quat content of the improved cleaning composition is about 0.175–0.6 weight percent. In yet a further aspect of this embodiment, the quat content of the improved cleaning composition is about 0.2–0.5 weight percent. In still a further aspect of this embodiment, the quat content of the improved cleaning composition is about 0.25–0.4 weight percent. In still another embodiment, when one or more quats are combined with one or more biguanides to function as the primary biocide in the improved cleaning composition, the quat content is about 0.001–5 weight percent of the improved cleaning composition and the biguanide content is also about 0.001–5 weight percent of the improved cleaning composition. The specific quantities of the quat and biguanide compounds in the improved cleaning composition is typically a function of economic cost considerations; local, state and/or federal regulatory restrictions; formula solubility requirements; streaking and residue properties of the improved cleaning composition; skin irritation considerations; and/or the intended use of the improved cleaning composition. In one specific aspect of this embodiment, the biguanide compound content is greater than the quat content in the improved cleaning composition.

In yet another aspect of the present invention, the improved cleaning composition includes one or more additional biocides used in combination with the biguanide compound and/or quat. Such biocides can include, but are not limited to, alcohols, peroxides, boric acid and borates, chlorinated hydrocarbons, organometallics, halogen-releasing compounds, mercury compounds, metallic salts, pine oil, organic sulfur compounds, iodine compounds, silver nitrate, quaternary phosphate compounds, and/or phenolics.

In yet another aspect of the present invention, the improved cleaning composition includes an effective amount of biocide release agent to increase the amount of biocide released from the cleaning wipe onto a surface to be disinfected, sanitized, and/or sterilized. It has been found that a significant amount of biocide that includes cationic compounds such as, but not limited to, biguanide compounds and quats are retained on a cleaning wipe during use of the cleaning wipe. Typically, a significant amount of the cationic biocide in the improved cleaning composition is retained on the cleaning wipe after use. For instance, over 60 percent of the biguanides content in a cleaning composition and over 50 percent of the quat content can be retained on the cleaning wipe. Similar retain levels of the cationic biocide compounds occur on various other absorbent and adsorbent materials. As a result, the cationic biocide content of the improved cleaning composition must be increased to compensate for this high retention phenomena. Consequently, the cationic biocide content is at least doubled in the improved cleaning composition. In addition, when a cationic biocide containing improved cleaning composition is used in conjunction with sponges (cellulose, synthetic, etc.), paper towels, napkins, cloths, towels, rags, mop heads, and the like, the cationic biocide is attracted to and retained by the sponges (cellulose, synthetic, etc.), paper towels, napkins, cloths, towels, rags, mop heads, and the like thus removing the biocide from the surface to be cleaned thereby reducing the effectiveness of the improved cleaning composition. It has been found that one source of this retention is related to the cationic properties of the biocide and the anionic properties of the cleaning wipe, sponges (cellulose, synthetic, etc.), paper towels, napkins, cloths, towels, rags, mop heads, and the like. Cleaning wipes, sponges (cellulose, synthetic, etc.), paper towels, napkins, cloths, towels, rags, mop heads, and the like that include wood pulp, a blend of wood pulp and/or synthetic fibers that are at least partially derived from wood pulp, include several anionic species such as carboxylate groups, ester groups and the like. These anionic species tend to bond to the cationic biocide thereby resulting in the biocide being retained on the cleaning wipe, sponges (cellulose, synthetic, etc.), paper towels, napkins, cloths, towels, rags, mop heads, and the like. The biocide release agent is formulated to mitigate or prevent this bonding phenomena thereby enabling the improved cleaning composition to include a lower biocide content without adversely affecting the disinfecting, sanitizing, and/or sterilizing efficacy of the cleaning wipe. The biocide release agent is a cationic compound designed to compete with the cationic biocide for the anionic species sites on the cleaning wipe thereby causing increased biocide release from the cleaning wipe during use of the cleaning wipe. The biocide release agent binds with the anionic species sites thereby freeing the cationic biocide from the cleaning wipe and allowing the biocide to be transferred to a surface to be cleaned. In one embodiment, the biocide release agent is formulated to have a higher affinity for the anionic species sites than the cationic biocide such that the site competition between the cationic biocide and the biocide release agent favors the biocide release agent. In one aspect of this embodiment, the affinity of the biocide release agent for the anionic species sites is significantly greater than the affinity of the cationic biocide for the anionic species sites thereby resulting in substantially irreversible bonding of the biocide release agent with the anionic species sites on the cleaning wipe. In another embodiment, the biocide release agent includes a cationic salt. Salts are desirable biocide release agents in that such compounds are generally inexpensive when compared to many types of cationic biocides. A variety of different salts can be used such as, but not limited to, monovalent salts, divalent salts, organic salts, and the like. These salts include, but are not limited to, acetates, acetylides, ammonium salts (excluding quats), arsenates, astatides, azides, bihalide salts, bicarbonates, bisulfides, borides, borohydrides, borohalides, carconates, citrates, cyanates, cyanides, formates, germanates, glycinates, halates, halides, hydrides, hydroselenides, hydrosulphides, hydroxides, imides, metaniobates, metaantalates, metavanadates, nitrates, nitrides, nitrites, oxides, perchlorates, phosphates, phosphonium salts, selenides, selenites, selenates, sulphides, sulphates, ternary salts, tetraalkyl ammonium salts, tellurides, thiocyanates, and/or vanadates. In one aspect of this embodiment, the biocide release agent includes, but is not limited to, potassium citrate, sodium citrate, sodium tartrate, potassium tartrate, potassium lactate, sodium lactate, salicylate salts of sodium and/or potassium, magnesium sulphate, sodium chloride, ammonium chloride, and/or potassium chloride. In another embodiment, a sufficient amount of biocide release agent is included in the improved cleaning composition to reduce the cationic biocide retention on the cleaning wipe, sponges (cellulose, synthetic, etc.), paper towels, napkins, cloths, towels, rags, mop heads, and the like to less than about 50%. In one aspect of this embodiment, the improved cleaning composition includes a sufficient amount of biocide release agent to reduce the cationic biocide retention on the cleaning wipe, sponges (cellulose, synthetic, etc.), paper towels, napkins, cloths, towels, rags, mop heads, and the like to less than about 45%. In another aspect of this embodiment, the improved cleaning composition includes a sufficient amount of biocide release agent to reduce the cationic biocide retention on the cleaning wipe, sponges (cellulose, synthetic, etc.), paper towels, napkins, cloths, towels, rags, mop heads, and the like to less than about 40%. In still another aspect of this embodiment, the improved cleaning composition includes a sufficient amount of biocide release agent to reduce the cationic biocide retention on the cleaning wipe, sponges (cellulose, synthetic, etc.), paper towels, napkins, cloths, towels, rags, mop heads, and the like to less than about 35%. In yet another aspect of this embodiment, the improved cleaning composition includes a sufficient amount of biocide release agent to reduce the cationic biocide retention on the cleaning wipe, sponges (cellulose, synthetic, etc.), paper towels, napkins, cloths, towels, rags, mop heads, and the like to less than about 30%. In still yet another aspect of this embodiment, the improved cleaning composition includes a sufficient amount of biocide release agent to reduce the cationic biocide retention on the cleaning wipe, sponges (cellulose, synthetic, etc.), paper towels, napkins, cloths, towels, rags, mop heads, and the like to less than about 25%. In a further aspect of this embodiment, the improved cleaning composition includes a sufficient amount of biocide release agent to reduce the cationic biocide retention on the cleaning wipe, sponges (cellulose, synthetic, etc.), paper towels, napkins, cloths, towels, rags, mop heads, and the like to less than about 20%. In still a further aspect of this embodiment, the improved cleaning composition includes a sufficient amount of biocide release agent to reduce the cationic biocide retention on the cleaning wipe, sponges (cellulose, synthetic, etc.), paper towels, napkins, cloths, towels, rags, mop heads, and the like to less than about 15%. In yet a further aspect of this embodiment, the improved cleaning composition includes a sufficient amount of biocide release agent to reduce the cationic biocide retention on the cleaning wipe, sponges (cellulose, synthetic, etc.), paper towels, napkins, cloths, towels, rags, mop heads, and the like to less than about 10%. In still yet a further aspect of this embodiment, the improved cleaning composition includes a sufficient amount of biocide release agent to reduce the cationic biocide retention on the cleaning wipe, sponges (cellulose, synthetic, etc.), paper towels, napkins, cloths, towels, rags, mop heads, and the like to less than about 5%. In another aspect of this embodiment, the improved cleaning composition includes a sufficient amount of biocide release agent to reduce the cationic biocide retention on the cleaning wipe, sponges (cellulose, synthetic, etc.), paper towels, napkins, cloths, towels, rags, mop heads, and the like to less than about 3%. In still another aspect of this embodiment, the improved cleaning composition includes a sufficient amount of biocide release agent to reduce the cationic biocide retention on the cleaning wipe, sponges (cellulose, synthetic, etc.), paper towels, napkins, cloths, towels, rags, mop heads, and the like to less than about 1%. In still another embodiment, the biocide release agent is present in the improved cleaning composition such that the biocide release agent has an effective ionic strength to cause a desired amount of cationic biocide to be released from the cleaning wipe, sponges (cellulose, synthetic, etc.), paper towels, napkins, cloths, towels, rags, mop heads, and the like. In one aspect of this embodiment, the effective ionic strength of the biocide release agent in the improved cleaning composition is at least about $5\times10^{-3}$ mol/l. It has been found that an ionic strength of less than about $5\times10^{-3}$ mol/l does not result in an appreciable increase in cationic biocide release from the cleaning wipe, sponges (cellulose, synthetic, etc.), paper towels, napkins, cloths, towels, rags, mop heads, and the like. In another aspect of this embodiment, the effective ionic strength of the biocide release agent in the improved cleaning composition is about $5\times10^{-3}$–18 mol/l. In still another aspect of this embodiment, the effective ionic strength of the biocide release agent in the improved cleaning composition is at least about $1\times10^{-2}$ mol/l. In yet another aspect of this embodiment, the effective ionic strength of the biocide release agent in the improved cleaning composition is about $1\times10^{-2}$–5 mol/l. In still yet another aspect of this embodiment, the effective ionic strength of the biocide release agent in the improved cleaning composition is about $2\times10^{-2}$–1 mol/l. In a further aspect of this embodiment, the effective ionic strength of the biocide release agent in the improved cleaning composition is about $3\times10^{-2}$–0.4 mol/l. In yet a further aspect of this embodiment, the effective ionic strength of the biocide release agent in the improved cleaning composition is about $4\times10^{-2}$–0.2 mol/l. The weight percent of the biocide release agent in the improved cleaning composition to achieve a particular ionic strength in the improved cleaning composition is a function of the molecular weight of the biocide release agent and the ionic strength of the biocide release agent. In yet another embodiment, the biocide release agent content of the improved cleaning composition is at least about 0.025 weight percent and can constitute up to about 90 weight percent. In one aspect of this embodiment, the biocide release agent content of the improved cleaning composition is about 0.03–10 weight percent. In another aspect of this embodiment, the biocide release agent content of the improved cleaning composition is about 0.04–5 weight percent. In still another aspect of this embodiment, the biocide release agent content of the improved cleaning composition is about 0.08–3 weight percent. In yet another aspect of this embodiment, the biocide release agent content of the improved cleaning composition is about 0.1–2.5 weight percent. In still yet another aspect of this embodiment, the biocide release agent content of the improved cleaning composition is about 0.2–2.5 weight percent. In a further aspect of this embodiment, the biocide release agent content of the improved cleaning composition is about 0.5–2 weight percent. In still a further aspect of this embodiment, the biocide release agent content of the improved cleaning composition is about 0.75–1.8 weight percent.

In still another aspect of the present invention, the improved cleaning composition includes an effective amount of surfactant. The inclusion of the surfactant in the improved cleaning composition improves the cleaning performance of the improved cleaning composition (e.g improve wetting properties of the improved cleaning composition, stabilizes components in the improved cleaning composition, functions as an emulsifying agent, etc). A variety of surfactants can be used in the improved cleaning composition. Such surfactants include anionic, cationic, zwitterionic, and/or amphoteric surfactants. Many of these surfactants are described in *McCutcheon's Emulsifiers and Detergents* (1997), *Kirk-Othmer, Encyclopedia of Chemical Technology* 3rd Ed., Volume 22, pp. 332–432 (Marcel-Dekker, 1983), and *McCutcheon's Soaps and Detergents* (N. Amer. 1984), the contents of which are hereby incorporated by reference. In one embodiment, the surfactant includes, but is not limited to, glycoside, glycols, ethylene oxide and mixed ethylene oxide/propylene oxide adducts of alkylphenols, the ethylene oxide and mixed ethylene oxide/propylene oxide adducts of long chain alcohols or of fatty acids, mixed ethylene oxide/propylene oxide block copolymers, esters of fatty acids and hydrophilic alcohols, sorbitan monooleates, alkanolamides, soaps, alkylbenzene sulfonates, olefin sulfonates, paraffin sulfonates, propionic acid derivatives, alcohol and alcohol ether sulfates, phosphate esters, amines, amine oxides, alkyl sulfates, alkyl ether sulfates, sarcosinates, sulfoacetates, sulfosuccinates, coco-amphocarboxy glycinate, salts of higher acyl esters of isethionic acid, salts of higher acyl derivatives of taurine or methyltaurine, phenol poly ether sulfates, higher acyl derivatives of glycine and methylglycine, alkyl aryl poly-ether alcohols, salts of higher alkyl substituted imadazolinium dicarboxylic acids, ferchorics, tannics, naphthosulfonates, monochloracetics anthraflavinics, hippurics, anthranilics, naphthoics, phthalics, carboxylic acid salts, acrylic acids, phosphates, alkylamine ethoxylates, ethylenediamine alkoxylates, betaines, sulfobetaines, and/or imidazolines. In one aspect of this embodiment, the surfactant includes, but is not limited to, lauryl sulfate, laurylether sulfate, cocamidopropylbetaine, alkyl polyglycosides, and/or amine oxides. In one aspect of this embodiment, the surfactant includes, but is not limited to, lauryl sulfate, laurylether sulfate, cocamidopropylbetaine, alkyl polyglycosides, and/or amine oxides. In another aspect of this embodiment, the surfactant includes an amine oxide having the general formula:

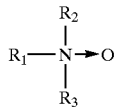

wherein $R_1$ is a $C_{6-30}$ alkyl, and $R_2$ and $R_3$ are $C_{1-6}$ alkyl or hydroxyalkyl. These amine oxides can be ethoxylated and/or propoxylated. One specific amine oxide includes, but is not limited to, alkyl di (hydroxy lower alkyl) amine oxides, alkylamidopropyl di (lower alkyl) amine oxides, alkyl di (lower alkyl) amine oxides, and/or alkylmorpholine oxides, wherein the alkyl group has 5–25 carbons and can be branched, unbranched, saturated, and/or unsaturated. Non-limiting examples of amine oxides include, but are not limited to, lauryl amine oxide sold under the name Barlox 12 from Lonza. In another embodiment, the surfactant includes an ethoxylated alcohol. The alkyl group can have 6–22 carbons. Typically, the alkyl group is linear. As can be appreciated, the alkyl groups can be branches. Furthermore, the carbon groups can be saturated or unsaturated. Typically the surfactant is partially or fully soluble in water. One type of non-limiting ethoxylated alcohol that can be used is Surfonic L series surfactants by Huntsman. In still another embodiment, the surfactant includes a fluorosurfactant. One non-limiting type of fluorosurfactant that can be used is an ethoxylated noninoic fluorosurfactant. Typically the surfactant is partially or fully soluble in water. One type of non-limiting ethoxylated noninoic fluorosurfactant that can be used is Zonyl surfactants by DuPont. In another embodiment, the surfactant, when included in the improved cleaning composition, is present in an amount of at least about 0.001 weight percent of the improved cleaning composition. The amount of surfactant present in the improved cleaning composition is controlled to reduce the raw material cost of the improved cleaning composition and/or to restrict the dissolved actives which can contribute to residues remaining when the improved cleaning composition is applied to a surface. In one aspect of this embodiment, the surfactant content in the improved cleaning composition is about 0.01–10 weight percent. The concentration of the surfactant in the improved cleaning composition may exceed 10 weight percent when the improved cleaning composition is in a concentrated form. In another aspect of this embodiment, the surfactant content in the improved cleaning composition is about 0.01–5 weight percent. In still another aspect of this embodiment, the surfactant content in the improved cleaning composition is about 0.05–5 weight percent. In yet another aspect of this embodiment, the surfactant content in the improved cleaning composition is about 0.075–5 weight percent. In still yet another aspect of this embodiment, the surfactant content in the improved cleaning composition is about 0.05–3 weight percent. In a further aspect of this embodiment, the surfactant content in the improved cleaning composition is about 0.075–2 weight percent. In still a further aspect of this embodiment, the surfactant content in the improved cleaning composition is about 0.1–2 weight percent. In yet a further aspect of this embodiment, the surfactant content in the improved cleaning composition is about 0.15–1.5 weight percent. In still yet a further aspect of this embodiment, the surfactant content in the improved cleaning composition is about 0.2–1.5 weight percent. In another aspect of this embodiment, the surfactant content in the improved cleaning composition is about 0.2–1.25 weight percent. In yet another aspect of this embodiment, the surfactant content in the improved cleaning composition is about 0.5–1.25 weight percent. In still another aspect of this embodiment, the surfactant content in the improved cleaning composition is about 0.1–1 weight percent. In still yet another aspect of this embodiment, the surfactant content in the improved cleaning composition is about 0.15–0.8 weight percent. In a further aspect of this embodiment, the surfactant content in the improved cleaning composition is about 0.2–0.4 weight percent. In yet a further aspect of this embodiment, the surfactant content in the improved cleaning composition is less than about 0.5 weight percent.

In still another aspect of the present invention, the improved cleaning composition includes a builder detergent. The builder detergent, when used, typically increases the effectiveness of the surfactant in the improved cleaning composition when a surfactant is included in the improved cleaning composition. The builder detergent can also function as a softener and/or a sequestering and buffering agent in the improved cleaning composition. A variety of builder detergents can be used in the improved cleaning composition. Such builder detergents include, but are not limited to, phosphate-silicate compounds, zeolites, alkali metal, ammonium and substituted ammonium polyacetates, trialkali salts of nitrilotriacetic acid, carboxylates, polycarboxylates, carbonates, bicarbonates, polyphosphates, aminopolycarboxylates, polyhydroxysulfonates, and/or starch derivatives. In one embodiment, the builder detergent includes polyacetate and/or polycarboxylate compounds. In one aspect of this embodiment, the polyacetate and/or polycarboxylate compounds include, but are not limited to, sodium, potassium, lithium, ammonium, and substituted ammonium salts of ethylenediamine tetraacetic acid, ethylenediamine triacetic acid, ethylenediamine tetrapropionic acid, diethylenetriamine pentaacetic acid, nitrilotriacetic acid, oxydisuccinic acid, iminodisuccinic acid, mellitic acid, polyacrylic acid or polymethacrylic acid and copolymers, benzene polycarboxylic acids, gluconic acid, sulfamic acid, oxalic acid, phosphoric acid, phosphonic acid, organic phosphonic acids, acetic acid, and citric acid. These builder detergents can also exist either partially or totally in the hydrogen ion form. In another aspect of this embodiment, the builder detergent includes EDTA and/or EDTA salts. When EDTA salts are included in the improved cleaning composition, the EDTA salts contribute to the release of the cationic biocide from the cleaning wipe when the improved cleaning composition is loaded onto a cleaning wipe. The cationic properties of the EDTA salts compete for the anionic species sites on the cleaning wipe thereby causing some cationic biocide to be released from the cleaning wipe. Although the EDTA salts contribute to some cationic biocide release when sufficient amounts of EDTA salts are included in the cleaning agent, the amount of cationic biocide release attributable to the EDTA salts is very small due to the low ionic strength of the EDTA salts. Consequently, EDTA salts in the improved cleaning composition are not a substitute for the biocide release agent, and the absence of a biocide release agent from the improved cleaning composition results in little or no measurable reduction in cationic biocide retention on the cleaning wipe. In one specific aspect, the builder agent includes sodium and/or potassium salts of EDTA. In still another embodiment, the builder detergent includes substituted ammonium salts. In one aspect of this embodiment, the substituted ammonium salts include, but are not limited to, ammonium salts of methylamine, dimethylamine, butylamine, butylenediamine, propylamine, triethylamine, trimethylamine, monoethanolamine, diethanolamine, triethanolamine, isopropanolamine, ethylenediamine tetraacetic acid and/or propanolamine. In yet another embodiment, the improved cleaning composition includes at least about 0.001 weight percent builder detergent when builder detergent is included in the improved cleaning composition.

In one aspect of this embodiment, the builder detergent content in the improved cleaning composition is about 0.01–2 weight percent. The concentration of the builder detergent in the improved cleaning composition may exceed about 2 weight percent when the improved cleaning composition is in a concentrated form. In another aspect of this embodiment, the builder detergent content in the improved cleaning composition is about 0.01–1 weight percent. In still another aspect of this embodiment, the builder detergent content in the improved cleaning composition is about 0.01–0.8 weight percent. In yet another aspect of this embodiment, the builder detergent content in the improved cleaning composition is about 0.05–0.75 weight percent. In still yet another aspect of this embodiment, the builder detergent content in the improved cleaning composition is about 0.05–0.5 weight percent. In a further aspect of this embodiment, the builder detergent content in the improved cleaning composition is about 0.07–0.3 weight percent. In still a further aspect of this embodiment, the builder detergent content in the improved cleaning composition is about 0.09–0.25 weight percent.

In still another aspect of the present invention, the improved cleaning composition includes a solvent. The solvent is used to dissolve various components in the improved cleaning composition so as to form a substantially uniformly dispersed mixture. In addition to the dispersion and solubilizing functions of the solvent, the solvent can function as a cleaning agent to help loosen and solubilize compounds such as greasy or oily soils from surfaces, a residue inhibiting agent to help reduce residues left behind on a cleaned surface, a detergent agent to assist in the detergency of the improved cleaning composition, and/or a disinfecting, sanitizing, and/or sterilizing agent to help eliminate various bacteria and/or viruses on a cleaned surface. The solvent, when used, can be premixed with the other components of the improved cleaning composition or be partially or fully added to the improved cleaning composition prior to use. In one embodiment, the solvent is water soluble and/or a dispersable organic solvent. In another embodiment, the solvent rapidly volatilizes. In one aspect of this embodiment, the solvent has a vapor pressure of at least about 0.001 mm Hg at about 25° C. In another aspect of this embodiment, the solvent volatilizes in no more than about 5 minutes at ambient temperature (about 25° C.) after contact with a surface. In another embodiment, the solvent volatilizes from a surface substantially without leaving a residue. In still another embodiment, the solvent includes, but is not limited to, $C_{1-6}$ alkanols, $C_{1-6}$ diols, $C_{1-10}$ alkyl ethers of alkylene glycols, $C_{3-24}$ alkylene glycol ethers; and discrete amounts of polyalkylene glycols, short chain carboxylic acids, short chain esters, isoparafinic hydrocarbons, mineral spirits, alkylaromatics, terpenes, terpene derivatives, terpenoids, terpenoid derivatives, formaldehyde, and/or pyrrolidones may be added as desired. In one aspect of this embodiment, the alkanol includes, but is not limited to, methanol, ethanol, n-propanol, isopropanol, butanol, pentanol, and/or hexanol, and their various positional isomers. In another aspect of this embodiment, the diols include, but are not limited to, methylene, ethylene, propylene and/or butylene glycols. In still another aspect of this embodiment, alkylene glycol ether solvents include, but are not limited to, ethylene glycol monopropyl ether, ethylene glycol monobutyl ether, propylene glycol n-propyl ether, propylene glycol monobutyl ether, propylene glycol t-butyl ether, diethylene glycol monoethyl or monopropyl or monobutyl ether, di- or tri-polypropylene glycol methyl or ethyl or propyl or butyl ether, acetate and/or propionate esters of glycol ethers. In yet another aspect of this embodiment, the short chain carboxylic acids include, but are not limited to, acetic acid, glycolic acid, lactic acid and/or propionic acid. In still yet another aspect of this embodiment, the short chain esters include, but are not limited to, glycol acetate, and/or cyclic or linear volatile methylsiloxanes. In a further aspect of this embodiment, water insoluble solvents such as isoparafinic hydrocarbons, mineral spirits, alkylaromatics, terpenoids, terpenoid derivatives, terpenes, and/or terpenes derivatives are mixed with a water soluble solvent when included in the improved cleaning composition. When water insoluble solvents are mixed with a water soluble solvent in the improved cleaning composition, the weight percentage of the water insoluble solvent in the improved cleaning composition is generally less than about 10 weight percent, typically less than about 5 weight percent, and more typically less than about 1 weight percent of the improved cleaning composition. As can be appreciated, the improved cleaning composition can be a non aqueous cleaner wherein little, if any, water is included in the improved cleaning composition. In such a formulation, weight percentage of the water insoluble solvent may be greater than about 10 weight percent. In one specific aspect, the water insoluble solvent includes, but is not limited to, tertiary alcohols, hydrocarbons (e.g. alkanes), pine-oil, terpinoids, turpentine, turpentine derivatives, terpenoid derivatives, terpinolenes, limonenes, pinenes, terpene derivatives, benzyl alcohols, phenols, and/or their homologues. Certain terpene derivatives that can be used include, but are not limited to, d-limonene, Terpene EX, dipentene and oc-pinene. In still a further aspect of this embodiment, the pyrrolidones include, but are not limited to, N-methyl-2-pyrrolidone, N-octyl-2-pyrrolidone and/or N-dodecyl-2-pyrrolidone. In one particular formulation for the improved cleaning composition, the solvents include, but are not limited to, n-propanol, isopropanol, butanol, PnB, DPnB, acetone, and/or Hexyl Cellosolve. In one particular improved cleaning composition formulation, the solvent includes isopropanol and/or PnB. In still another embodiment, the improved cleaning composition includes at least about 0.5 weight percent solvent when solvent is included in the improved cleaning composition. Typically, the improved cleaning composition includes at least about 0.5 weight percent solvent to avoid solubility problems which can result from the combination of various components of the improved cleaning composition. In one aspect of this embodiment, the solvent content in the improved cleaning composition is about 0.5–70 weight percent. The concentration of the solvent in the improved cleaning composition may exceed about 70 weight percent when the improved cleaning composition is in a concentrated form. In another aspect of this embodiment, the solvent content in the improved cleaning composition is about 0.5–30 weight percent. In still another aspect of this embodiment, the solvent content in the improved cleaning composition is about 0.5–10 weight percent. In yet another aspect of this embodiment, the solvent content in the improved cleaning composition is about 0.75–7 weight percent. In still yet another aspect of this embodiment, the solvent content in the improved cleaning composition is about 0.75–6 weight percent. In a further aspect of this embodiment, the solvent content in the improved cleaning composition is about 1–5 weight percent. In still a further aspect of this embodiment, the solvent content in the improved cleaning composition is about 2–4 weight percent. In yet a further aspect of this embodiment, the solvent content in the improved cleaning composition is about 2.5–4 weight percent.

In still yet another aspect of the present invention, the improved cleaning composition includes water. The water, when used, can be premixed with the other components of the improved cleaning composition or be partially or fully added to the improved cleaning composition prior to use. The water can be tap water, distilled water, deionized water, and/or industrial soft water. The amount of water in the improved cleaning composition depends on whether the improved cleaning composition is an aqueous or nonaqueous composition. In one embodiment, the water is deionized water and/or industrial soft water. The use of deionized water and/or industrial soft water reduces residue formation and limits the amount of undesirable metal ions in the improved cleaning composition. In another embodiment, the cleaner composition is an aqueous composition, and the water constitutes at least a majority weight percent of the improved cleaning composition. The amount of water in the improved cleaning composition is less when the improved cleaning composition is in a concentrated liquid or semi-liquid form, or in a solid form. In one aspect of this embodiment, the water content in the ready to use improved cleaning composition is at least about 70 weight percent. The term "ready to use" means the improved cleaning composition does not need to be diluted or mixed with water and/or other solvent prior to use, or the concentrated cleaning solution has been diluted with water and/or other solvent. In another aspect of this embodiment, the water content in the ready to use improved cleaning composition is at least about 80 weight percent. In still another aspect of this embodiment, the water content in the ready to use improved cleaning composition is at least about 90 weight percent. In yet another aspect of this embodiment, the water content in the ready to use improved cleaning composition is at least about 95 weight percent.

In a further aspect of the present invention, the improved cleaning composition includes one or more adjuncts. The adjuncts include, but are not limited to, buffering and pH adjusting agents, fragrances or perfumes, waxes, dyes and/or colorants, solubilizing materials, stabilizers, thickeners, defoamers, hydrotropes, lotions and/or mineral oils, enzymes, bleaching agents, cloud point modifiers, preservatives, and/or polymers. In one embodiment, the buffering and pH adjusting agents, when used, include, but are not limited to, organic acids, mineral acids, alkali metal and alkaline earth salts of silicate, metasilicate, polysilicate, borate, carbonate, carbamate, phosphate, polyphosphate, pyrophosphates, triphosphates, tetraphosphates, ammonia, hydroxide, monoethanolamine, monopropanolamine, diethanolamine, dipropanolamine, triethanolamine, and/or 2-amino-2-methylpropanol. In another embodiment, the waxes, when used, include, but are not limited to, carnauba, beeswax, spermacet, candelilla, paraffin, lanolin, shellac, esparto, ouricuri, polyethylene wax, chlorinated naphthaline wax, petrolatum, microcrystalline wax, ceresine wax, ozokerite wax, and/or rezowax. In yet another embodiment, the solubilizing materials, when used, include, but are not limited to, hydrotropes (e.g. water soluble salts of low molecular weight organic acids such as the sodium and/or potassium salts of xylene sulfonic acid). In another embodiment, the acids, when used, include, but are not limited to, organic hydroxy acids, citric acids, keto acid, and the like. In still another embodiment, thickeners, when used, include, but are not limited to, polyacrylic acid, xanthan gum, calcium carbonate, aluminum oxide, alginates, guar gum, methyl, ethyl, clays, and/or propylhydroxycelluloses. In yet another embodiment, defoamers, when used, include, but are not limited to, silicones, aminosilicones, silicone blends, and/or silicone/hydrocarbon blends. In still yet another embodiment, lotions, when used, include, but are not limited to, achlorophene and/or lanolin. In a further embodiment, enzymes, when used, include, but are not limited to, lipases and proteases, and/or hydrotropes such as xylene sulfonates and/or toluene sulfonates. In a further embodiment, bleaching agents, when used, include, but are not limited to, peracids, hypohalite sources, hydrogen peroxide, and/or sources of hydrogen peroxide. In a further embodiment, preservatives, when used, include, but are not limited to, mildewstat of bacteriostat, methyl, ethyl and propyl parabens, short chain organic acids (e.g. acetic, lactic and/or glycolic acids), bisguanidine compounds (e.g. Dantagard and/or Glydant) and/or short chain alcohols (e.g. ethanol and/or IPA). In one aspect of this embodiment, the mildewstat of bacteriostat includes, but is not limited to, mildewstats (including non-isothiazolone compounds) include Kathon GC, a 5-chloro-2-methyl-4-isothiazolin-3-one, Kathon ICP, a 2-methyl-4-isothiazolin-3-one, and a blend thereof, and Kathon 886, a 5-chloro-2-methyl-4-isothiazolin-3-one, all available from Rohm and Haas Company; Bronopol, a 2-bromo-2-nitropropane 1,3diol, from Boots Company Ltd.; Proxel CRL, a propyl-p-hydroxybenzoate, from ICI PLC; Nipasol M, an o-phenylphenol, Na+ salt, from Nipa Laboratories Ltd.; Dowicide A, a 1,2-Benzoisothiazolin-3-one, from Dow Chemical Co.; and Irgasan DP 200, a 2,4,4'-trichloro-2-hydroxydiphenylether, from Ciba-Geigy A.G. In still a further embodiment, polymers, when used, include, but are not limited to, polysaccharides, polycarboxylates, polystyrenesulfonates, acrylate polymers, polyethyleneimines, polyvinylpyrrolidones, methylvinyl ether, polyvinyl alcohols, silicones, and/or polyethylene glycols. In one aspect of this embodiment, the polymer, when used, is generally a water soluble or dispersable polymer having a molecular weight of generally below 2,000,000 daltons. In another aspect of this embodiment, polysaccharide polymers include, but are not limited to, substituted cellulose materials like carboxymethylcellulose, ethyl cellulose, hydroxyethylcellulose, hydroxypropylcellulose, hydroxymethylcellulose, succinoglycan and naturally occurring polysaccharide polymers like xanthan gum, guar gum, locust bean gum, tragacanth gum or derivatives thereof, sodium casceinate, gelatin, cationic cellulose ether, and/or Polymer JR. In still another aspect of this embodiment, polycarboxylates include, but are not limited to, ethylene, simple olefin, styrene, alphamethylstyrene, methyl, ethyl and $C_{3-8}$ alkyl acrylates and methacrylates, isobornyl methacrylate, acrylamide, hydroxyethyl acrylate and methacrylate, hydroxypropyl acrylate and methacrylate, N-vinyl pyrrolidone, butadiene, isoprene, vinyl halides such as vinyl chloride and vinylidine chloride, alkyl maleates, alkyl funarates, acrylic acid, methacrylic acid, polycarboxylic acids, sulfonic acids, phosphoric acids, maleic anhydride, ethylene and/or propylene. In yet another aspect of this embodiment, polystyrenesulfonates include, but are not limited to, Flexan 130, Versa TL-4, and/or Versa TL501 from ALCO Corporation. In still another aspect of this embodiment, acrylate polymers include, but are not limited to, cationic acrylic water soluble polymers that are copolymers of cationic quaternized acrylates, methacrylates, acrylamides, and methacrylamides; and/or copolymers of one or more acidic monomers such as acrylic acid, methacrylic acid or maleic anhydride with at least one other ethylenically unsaturated monomer selected from a group of ethylene and other simple olefin, styrene, alpha-methylstyrene, methyl, ethyl and $C_3$ to $C_8$ alkyl acrylates and methacrylates, isobornyl methacrylate, acrylamide, hydroxyethyl acrylate and methacrylate, hydroxypropyl acrylate and methacrylate, N-vinyl pyrrolidone, butadiene, isoprene, vinyl halides such as vinyl chloride and vinylidine chloride, alkyl maleates, alkyl fumarates, fumaric acid, maleic acid, itaconic acid, acetoacetoxy methacrylate or other acetoacetate monomers, and/or divinyl or polyvinyl monomers, such as glycol polyacrylates, allyl methacrylate, and divinyl benzene. In a further aspect of this embodiment, polyvinylpyrrolidone includes, but is not limited to, copolymers of N-vinylpyrrolidone with one or more aklylenically unsaturated monomers such as unsaturated dicarboxylic acids such as maleic acid, chloromaleic acid, fumaric acid, itaconic acid, citraconic acid, phenylmaleic acid, aconitic acid, acrylic acid, methacrylic acid, N-vinylimidazole, vinylcaprolactam, butene, hexadecene, and vinyl acetate. In addition, any of the esters and amides of the unsaturated acids may be employed, for example, methyl acrylate, ethylacrylate, acrylamide, methacryamide, dimethylaminoethylmethacrylate, dimethylaminopropylmethacrylamide, trimethylammoniumethylmethacrylate, and trimethylammoniumpropylmethacrylamide. Other suitable alkylencially unsaturated monomers include aromatic monomers such as styrene, sulphonated styrene, alpha-methylstyrene, vinyltoluene, t-butylstyrene and others. In yet a further aspect of this embodiment, the silicones include, but are not limited to, polysicoxanes.

In still a further aspect of the present invention, the improved cleaning composition has a neutral or alkaline pH. Various adjuncts that be added to the improved cleaning composition to control the pH of the improved cleaning composition. In one embodiment, the pH of the cleaning composition is alkaline. In one aspect of this embodiment, the pH of the improved cleaning composition is between about 7–12. In another aspect of this embodiment, the pH of the improved cleaning composition is between about 7.2–10.5.

The principal object of the present invention is to provide an improved cleaning composition having improved cleaning attributes.

Another and/or alternative object of the present invention is to provide an improved cleaning composition having improved disinfecting, sanitizing, and/or sterilizing properties.

Yet another and/or alternative object of the present invention is to provide an improved cleaning composition that can be pre-loaded or post-loaded on an absorbent or absorbent material.

Still another and/or alternative object of the present invention is to provide an improved cleaning composition that exhibits improved biocidal release from an absorbent or absorbent material.

Yet another and/or alternative object of the present invention is to provide an improved cleaning composition that includes a biguanide compound and/or quat as one of the principal disinfecting, sanitizing, and/or sterilizing agents.

Still yet another and/or alternative object of the present invention is to provide an improved cleaning composition having a reduced solvent content.

Another and/or alternative object of the present invention is to provide an improved cleaning composition having a reduced toxicity without impairing the disinfecting, sanitizing, and/or sterilizing attributes of the improved cleaning composition.

Yet another and/or alternative object of the present invention is to provide an improved cleaning composition having a reduced raw material cost.

Still another and/or alternative object of the present invention is to provide an improved cleaning composition that exhibits reduced streaking and/or filming.

A further and/or alternative object of the present invention is to provide an improved cleaning composition that can be used to disinfect, sanitize, and/or sterilize a variety of surfaces.

Still a further and/or alternative object of the present invention is to provide an improved cleaning composition that can to formulated in a concentrated or ready to use form.

Still yet a further and/or alternative object of the present invention is to provide an improved cleaning composition that can be used in conjunction with or separately from an absorbent or adsorbent material.

Another and/or alternative object of the present invention is to provide an improved cleaning composition that can be formed as an aerosol, liquid, semi-liquid or solid form.

Still another and/or alternative object of the present invention is to provide an improved cleaning composition is alkaline.

These and other objects and advantages will become apparent to those skilled in the art upon reading and following the description of the invention taken together with the accompanied drawing.

BRIEF DESCRIPTION OF THE DRAWINGS

Reference may now be made to the drawings, which illustrates various attributes of the invention wherein.

DETAILED DESCRIPTION OF THE PREFERRED EMBODIMENTS

Figure 1:
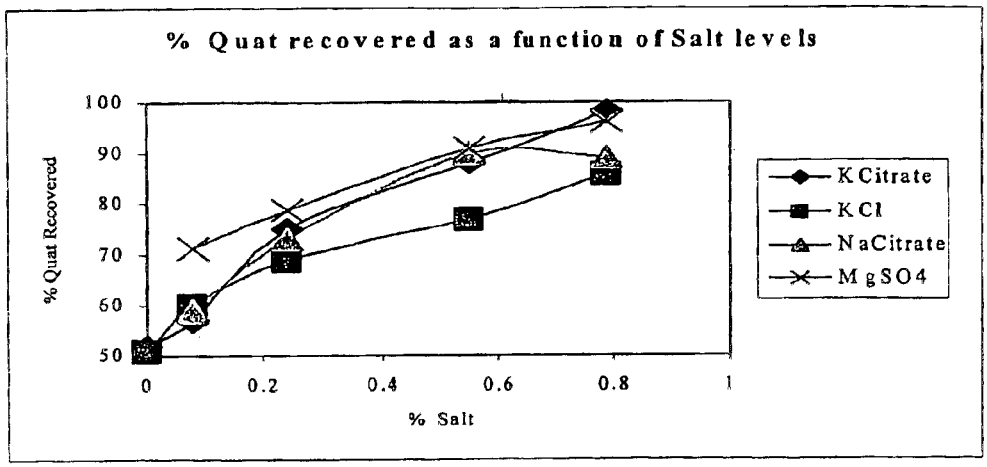
FIG. 1 is a graphical illustration of the percentage of quat recovered from the cleaning wipe as a function of the weight percentage of several different type of salts in the improved cleaning composition; and, FIG. 2 is a graphical illustration of the percentage of biguanide compound recovered from the cleaning wipe as a function of the weight percentage of salt in the improved cleaning composition.

The improved cleaning composition of the present invention can be used independently from or in conjunction with an absorbent and/or adsorbent material. For instance, the improved cleaning composition is formulated to be used in conjunction with a cleaning wipe, sponge (cellulose, synthetic, etc.), paper towel, napkin, cloth, towel, rag, mop head, squeegee, and/or other cleaning device that includes an absorbent and/or adsorbent material. The improved cleaning composition is particularly formulated to be loaded onto a cleaning wipe which cleaning wipe includes wood pulp and/or wood pulp derivatives. The improved cleaning composition can be pre-loaded onto an absorbent and/or adsorbent material, post-absorbed and/or post-adsorbed by a material during use, and/or be used separately from an absorbent and/or adsorbent material. Hereinafter, the improved cleaning composition will be described in terms of its composition and/or in combination with a cleaning wipe. The improved cleaning composition will also be described in a ready to use liquid form; however, the improved cleaning composition can be formulated as a concentrate in liquid, semi-liquid or solid form, or be formulated for aerosol use.

The cleaning wipe, upon which the improved cleaning composition is loaded thereon, is made of an absorbent/adsorbent material. Typically, the cleaning wipe has at least one layer of nonwoven material. Nonlimiting examples of commercially available cleaning wipes that can be used include DuPont 8838, Dexter ZA, Dexter 10180, Dexter M10201, Dexter 8589, Ft. James 836, and Concert STD60LN. All of these cleaning wipes include a blend of polyester and wood pulp. Dexter M10201 also includes rayon, a wood pulp derivative. The loading ratio of the improved cleaning composition onto the cleaning wipe is about 2–5:1, and typically about 3–4:1. The improved cleaning composition is loaded onto the cleaning wipe in any number of manufacturing methods. Typically, the cleaning wipe is soaked in the improved cleaning composition for a period of time until the desired amount of loading is achieved. The cleaning wipe loaded with the improved cleaning composition provides excellent cleaning with little or no streaking/filming.

The basic components of the aqueous improved cleaning composition include:

(i) a cationic biocide;

(ii) a biocide release agent; and (iii) water.

Additional components can be included in the improved cleaning composition to add one or more attributes to the improved cleaning composition and/or to enhance the attributes of the improved cleaning composition.

The cationic biocide in the improved cleaning composition typically includes one or more biguanide compounds and/or one or more quats. Biguanide compounds and/or quats are desirable in that such compounds have a broad spectrum antimicrobial or germicidal properties. A variety of different biguanide compounds can be used in the improved cleaning composition. The biguanide compounds, when used in the improved cleaning composition include, but are not limited to, compounds have the following general formula:

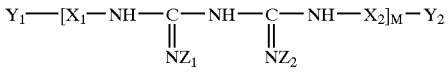

where $X_1$ and $X_2$ are hydrogen or any aliphatic, cycloaliphatic, aromatic, substituted aliphatic, substituted aromatic, heteroaliphatic, heterocyclic, or heteroaromatic compound, or a mixture of any of these. $Y_1$ and $Y_2$ are any aliphatic, cycloaliphatic, aromatic, substituted aliphatic, substituted aromatic, heteroaliphatic, heterocyclic, or heteroaromatic compound, or a mixture of any of these. M is an number equal to or greater than 1. Typically, M has an average value such that the molecular weight biguanide compounds is about 1000–1400; however, the molecular weight can be higher or lower. Generally, M is about 2–20. $Z_1$ and $Z_2$ are hydrogen or a hydrogen bonded to a salt. In addition or alternatively, the biguanide compounds include, but are not limited to, halogenated hexidine and its salts. One particular nonlimiting biguanide compound that can be used in the improved cleaning composition is Vantocil P(PHMB) commercially available from Avecia. The biguanide compound content of the improved cleaning composition, when used, is generally maintained at least above 0.0005 weight percent, and more generally above about 0.02 weight percent and less than about 20 weight percent; however, higher or lower biguanide compound contents can be used. Typically, the biguanide compound content of the improved cleaning composition, when used, is about 0.1–0.5 weight percent. This weight percentage range for the biguanide compound in the improved cleaning composition is selected to disinfect, sanitize, and/or sterilize most common household and industrial surfaces. Common types of bacteria that are destroyed by the improved cleaning composition include, but are not limited to, *Staphylococcus aureus* (Staph), Kleb, *Salmonella choleraesuis* (*Salmonella*), *Pseudomonas aeruginosa, Serratia marcescens*, Influenza A2, *Candida albicans, Fusarium solani*, common viruses and/or fungi. The quat, when used in the improved cleaning composition includes, but are not limited to, compounds have the following general formula:

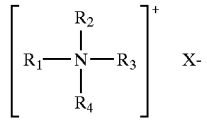

wherein X is an anion such as chloride, bromide, iodide, carbonate and/or an alkyl carboxylate; and $R_1$–$R_4$ are straight chain, branched chain and/or cyclic chain groups. One specific quat that can be used is an alkyldimethylbenzylammonium quat, an alkyldimethylethylbenzylammonium quat and/or an alkyldimethylammonium quat. One particular nonlimiting quat that can be used in the improved cleaning composition is a combination of alkyldimethylbenzylammonium chloride ($C_{14}$—60%, $C_{16}$— 30%, $C_{12}$—5%, $C_{18}$—5%) and alkyldimethylethylbenzylammonium chloride ($C_{12}$—68%, $C_{14}$—32%). This quat combination is commercially available as Barqaut 4250 and BARQUAT 4250Z by Lonza. The quat content of the improved cleaning composition, when used, is typically maintained above about 0.04 weight percent and less than about 20 weight percent; however, higher or lower quat contents can be used. Generally, the quat content of the improved cleaning composition is about 0.1–0.5 weight percent. When a quat and a biguanide compound is used in the cleaner, the quat plus biguanide content is at least about 0.03 weight percent of the improved cleaning composition. Typically, the quat content of the improved cleaning composition is less than or equal to the content of the biguanide compound in the improved cleaning composition; however, the quat content can be greater than the biguanide compound content. The weight percentage ranges for the biguanide compound and/or quat in the improved cleaning composition is selected to disinfect, sanitize, and/or sterilize most common household and industrial surfaces. As previously stated, common types of bacteria that are destroyed by the improved cleaning composition include, but are not limited to, *Staphylococcus aureus* (Staph), Kleb, *Salmonella choleraesuis* (*Salmonella*), *Pseudomonas aeruginosa, Serratia marcescens*, Influenza A2, *Candida albicans, Fusarium solani*, common viruses and/or fungi.

The biocide release agent used in the improved cleaning composition includes a cationic compound that is designed to compete with the cationic biocide (e.g. biguanide, quat, etc.) for anionic species sites on the cleaning wipe or other device or material that includes an absorbent and/or adsorbent material (e.g. sponges (cellulose, synthetic, etc.), paper towels, napkins, cloths, towels, rags, mop heads, squeegee). The cationic biocide release agent typically includes a cationic salt. Generally, a commonly available salt is used so as to minimize the raw material cost of the improved cleaning composition. In addition, a salt having a relatively high ionic strength per mole of salt is selected to minimize the amount of salt needed in the improved cleaning composition thereby also minimizing the raw material cost of the improved cleaning composition. Nonlimiting examples of salts that can be used in the improved cleaning composition include potassium citrate, sodium citrate, magnesium sulphate, sodium chloride, ammonium chloride, and/or potassium chloride. Generally, the one or more salts are added to the improved cleaning composition in an amount to cause over about 50% of the cationic biocide to be released from the cleaning wipe when the cleaning wipe is applied to a surface to be cleaned, or when some other device or material that includes an absorbent and/or adsorbent material (e.g. sponge, paper towel, napkin, cloth, towel, rag, squeegee, mop head) is used to clean a surface. Typically, the salt content of the improved cleaning composition is sufficient to cause at least about 75% of the cationic biocide to release from the cleaning wipe or other device or material that includes an absorbent and/or adsorbent material. Generally, the ionic strength of the one or more salts in the improved cleaning composition is about $1\times10^{-2}$–2 mol/l, and the weight percent of the salt in the improved cleaning composition is about 0.04–5 weight percent.

The water used in the ready to use improved cleaning composition generally constitutes a majority of the improved cleaning composition. Typically, the aqueous improved cleaning composition includes at least about 80 weight percent water; however, higher or lower water contents can be used. The water is typically deionized water and/or industrial soft water so as to reduce residue formation and limit the amount of undesirable metal ions in the improved cleaning composition.

The solvent, when used in the improved cleaning composition, dissolves into to solution the biguanide compound, quat and/or other organic compounds in the improved cleaning composition. The use of certain solvents can also improve the cleaning, biocidal and/or detergency aspects of the improved cleaning composition. Typically the solvent is water soluble and rapidly volatilizes substantially without leaving a residue. Generally the solvent includes, but is not limited to, $C_{1-6}$ alkanols, $C_{1-6}$ diols, $C_{1-10}$ alkyl ethers of alkylene glycols, $C_{3-24}$ alkylene glycol ethers, and/or polyalkylene glycols. Specific types of solvents include alkanols such as methanol, ethanol, n-propanol, isopropanol, butanol, pentanol, and/or hexanol, and their various positional isomers; and glycol ethers such as ethylene glycol monopropyl ether, ethylene glycol monobutyl ether, propylene glycol n-propyl ether, propylene glycol monobutyl ether, propylene glycol t-butyl ether, diethylene glycol monoethyl or monopropyl or monobutyl ether, di- or tri-polypropylene glycol methyl or ethyl or propyl or butyl ether, acetate and/or propionate esters of glycol ethers. Typically solvents include, but are not limited to, n-propanol, isopropanol, butanol, PnB, DPnB, acetone, and/or Hexyl Cellosolve by Union Carbide (ethylene glycol monohexyl ether). The solvent content of the improved cleaning composition is generally maintained above about 0.5 weight percent and less than about 10 weight percent; however, higher of lower solvent contents can be used. Typically, the solvent content of the improved cleaning composition is about 0.5–5 weight percent. The lower solvent weight percentages are especially desirable in jurisdictions wherein regulations require solvent concentrations of less than about 4–10 weight percent in the improved cleaning composition.

The improved cleaning composition also can include a builder detergent, surfactant and/or adjunct components. The builder detergent, when used in combination with a surfactant, can increase the effectiveness of the surfactant in the improved cleaning composition, as a softener and/or as a sequestering and buffering agent in the improved cleaning composition. Typically, the builder detergent includes sodium and/or potassium salts of EDTA. The builder detergent content, when used in the improved cleaning composition, is typically about 0.01–0.8 weight percent; however, higher or lower builder detergent contents can be used. Other adjunct components, when used, include buffering and pH adjusting agents, fragrances or perfumes, dyes and/or colorants, solubilizing materials, thickeners, defoarners, polymers, lotions and/or mineral oils, enzymes, bleaching agents, and/or preservatives.

A general formulation of the improved cleaning composition in weight percent is as follows:

| | |
|---|---|
| Biocide | 0.02–20% |
| Biocide release agent | 0.025–90% |
| Water | less than 99.95% |

wherein the ionic strength of the biocide release agent is at least about $5\times10^{-3}$ mol/l.

Several specific, nonlimiting, examples of the improved cleaning composition in weight percent are as follows. As can be appreciated, the formulas below can contain other components.

EXAMPLE 1

| | |
|---|---|
| Biocide | 0.02–10% |
| Biocide release agent | 0.03–10% |
| Builder detergent | 0–10% |
| Solvent | 0–99% |
| Surfactant | 0–10% |
| Water | 0–99.95% |

wherein the ionic strength of the biocide release agent is at least about $5\times10^{-3}$ mol/l.

EXAMPLE 2

| | |
|---|---|
| Biocide | 0.05–5% |
| Biocide release agent | 0.03–10% |
| Builder detergent | 0.001–2% |
| Solvent | 0.5–70% |
| Surfactant | 0.001–5% |
| Water | at least 10% |

wherein the ionic strength of the biocide release agent is at least about $5\times10^{-3}$ mol/l.

EXAMPLE 3

| | |
|---|---|
| Biocide | 0.02–5% |
| Biocide release agent | 0.03–5% |
| Builder detergent | 0–2% |
| Solvent | 0–20% |
| Surfactant | 0–5% |
| Water | at least 60% |

wherein the ionic strength of the biocide release agent is at least about $5\times10^{-3}$ mol/l.

EXAMPLE 4

| | |
|---|---|
| Biocide | 0.1–2% |
| Biocide release agent | 0.08–3% |
| Builder detergent | 0.01–2% |
| Solvent | 2–30% |
| Surfactant | 0.05–3% |
| Water | at least 60% |

wherein the ionic strength of the biocide release agent is at least about $1\times10^{-2}$ mol/l.

EXAMPLE 5

| | |
|---|---|
| Biocide | 0.04–2% |
| Biocide release agent | 0.05–2.5% |
| Builder detergent | 0–2% |
| Solvent | 0.04–10% |
| Surfactant | 0.01–5% |
| Water | at least 78.5% |

wherein the ionic strength of the biocide release agent is at least about $1\times10^{-2}$ mol/l.

EXAMPLE 6

| | |
|---|---|
| Biocide | 0.15–0.8% |
| Biocide release agent | 0.1–2.5% |
| Builder detergent | 0.01–0.8% |
| Solvent | 2–10% |
| Surfactant | 0.075–2% |
| Water | at least 80% |

wherein the ionic strength of the biocide release agent is about $2\times10^{-2}$–1 mol/l.

EXAMPLE 7

| | |
|---|---|
| Biocide | 0.1–2% |
| Biocide release agent | 0.1–2% |
| Builder detergent | 0–1% |
| Solvent | 0.1–5% |
| Surfactant | 0.1–4% |
| Water | at least 86% |

wherein the ionic strength of the biocide release agent is about $2\times10^{-2}$–1 mol/l.

EXAMPLE 8

| | |
|---|---|
| Biocide | 0.2–0.5% |
| Biocide release agent | 0.5–2% |
| Builder detergent | 0.05–0.5% |
| Solvent | 2.75–8% |
| Surfactant | 0.15–0.8% |
| Water | at least 85% |

wherein the ionic strength of the biocide release agent is about $3\times10^{-2}$–0.4 mol/l.

EXAMPLE 9

| | |
|---|---|
| Biocide | 0.1–1% |
| Biocide release agent | 0.1–2% |
| Builder detergent | 0–1% |
| Solvent | 0.1–5% |
| Surfactant | 0.1–4% |
| Water | at least 87% |

wherein the ionic strength of the biocide release agent is about $3\times10^{-2}$–0.4 mol/l.

EXAMPLE 10

| | |
|---|---|
| Biocide | 0.25–0.4% |
| Biocide release agent | 0.75–1.8% |
| Builder detergent | 0.075–0.25% |
| Solvent | 2.75–5% |
| Surfactant | 0.2–0.4% |
| Water | at least 85% |

wherein the ionic strength of the biocide release agent is about $4\times10^{-2}$–0.2 mol/l.

EXAMPLE 11

| | |
|---|---|
| BARQUAT 4250Z | 0.3–0.4% |
| Potassium Citrate | 0.09–1.1% |
| Disodium EDTA | 0.09–0.15% |
| Isopropanol | 3.5–5% |
| Lauryl Dimethyl Amine Oxide | 0.2–0.4% |
| Fragrance | 0–1% |
| Water | at least 90% |

wherein the ionic strength of the salts in the improved cleaning composition is about $3.5\times10^{-2}$–$5\times10^{-2}$ mol/l.

EXAMPLE 12

| | |
|---|---|
| Vantocil P | 0.1–0.5% |
| Isopropanol | 1.5–5% |
| PnB (glycol ether) | 0.5–2% |
| Surfactant | 0–1.5% |
| Ammonium Chloride | 0.05–1% |
| Dipotassium EDTA | 0–0.5% |
| Fragrance | 0–1% |
| Water | at least 89.5% |

wherein the ionic strength of the salts in the improved cleaning composition is about $3.5\times10^{-2}$–$5\times10^{-2}$ mol/l.

EXAMPLE 13

| | |
|---|---|
| BTC 2250 | 0.3–0.4% |
| Sodium Citrate | 0.9–1.1% |
| DiPotassium EDTA | 0.09–0.15% |
| Isopropanol | 3.5–5% |
| Lauryl Dimethyl Amine Oxide | 0.2–0.4% |
| Water | at least 90% |

wherein the ionic strength of the salts in the improved cleaning composition is about $3.75\times10^{-2}$–$5.4\times10^{-2}$ mol/l.

EXAMPLE 14

| | |
|---|---|
| Vantocil P | 0.15–0.5% |
| Isopropanol | 1.75–4% |
| PnB (glycol ether) | 0.5–1.5% |
| Surfactant | 0–1.5% |
| Ammonium Chloride | 0.05–1% |
| Dipotassium EDTA | 0–0.3% |
| Fragrance | 0–1% |
| Water | at least 90.8% |

wherein the ionic strength of the salts in the improved cleaning composition is about $3.75\times10^{-2}$–$5.4\times10^{-2}$ mol/l.

EXAMPLE 15

| | |
|---|---|
| BTC 2250 | 0.05–0.4% |
| Vantocil P | 0.05–0.4% |
| Sodium Citrate | 0.2–2% |
| DiPotassium EDTA | 0–0.5% |
| PnB (glycol ether) | 0–2% |
| Surfactant | 0–2% |
| Isopropanol | 0.1–5% |
| Lauryl Dimethyl Amine Oxide | 0–1% |
| Water | at least 90% |

wherein the ionic strength of the salts in the improved cleaning composition is about $3.75\times10^{-2}$–$5.4\times10^{-2}$ mol/l.

EXAMPLE 16

| | |
|---|---|
| BARQUAT 205M | 0.1–0.3% |
| Ammonium Chloride | 0.05–0.4% |
| DiPotassium EDTA | 0.3–0.5% |
| PnB (glycol ether) | 1–2% |
| Surfactant | 0.2–1% |
| Isopropanol | 1.5–4% |
| Lauryl Dimethyl Amine Oxide | 0–1% |
| Fragrance | 0–1% |
| Water | at least 90% |

wherein the ionic strength of the salts in the improved cleaning composition is about $3.75\times10^{-2}$–$5.4\times10^{-2}$ mol/l.

Several specific, nonlimiting examples of the improved cleaning composition loaded onto a cleaning wipe in weight percentage of the loaded cleaning wipe are as follows:

EXAMPLE 17

| | |
|---|---|
| Biocide | 0.025–4.17% |
| Biocide release agent | 0.015–8.33% |
| Builder detergent | 0.0005–1.67% |
| Solvent | 0.25–58.3% |
| Surfactant | 0.0005–4.17% |
| Water | at least 5% |
| Dry cleaning wipe | 16.7–50% |
| Loading ratio | 1–5:1 |

wherein the ionic strength of the biocide release agent is at least about $5\times10^{-3}$ mol/l.

EXAMPLE 18

| | |
|---|---|
| Biocide | 0.01–4.167% |
| Biocide release agent | up to 4.167% |
| Builder detergent | 0–1.67% |
| Solvent | 0.01–16.67% |
| Surfactant | 0–4.167% |
| Water | at least 34% |
| Dry cleaning wipe | 16.7–50% |
| Loading ratio | 1–5:1 |

wherein the ionic strength of the biocide release agent is at least about $5\times10^{-3}$ mol/l.

EXAMPLE 19

| | |
|---|---|
| Biocide | 0.1–0.64% |
| Biocide release agent | 0.067–2% |
| Builder detergent | 0.0067–0.64% |
| Solvent | 1.3–8% |
| Surfactant | 0.05–1.6% |
| Water | at least 53% |
| Dry cleaning wipe | 20–33% |
| Loading ratio | 2–4:1 |

wherein the ionic strength of the biocide release agent is at least about $2\times10^{-2}$ mol/l.

EXAMPLE 20

| | |
|---|---|
| Biocide | 0.067–0.8% |
| Solvent | 0.067–4% |
| Surfactant | 0–3.2% |
| Builder detergent | 0–0.8% |
| Biocide release agent | up to 1.6% |
| Water | at least 58% |
| Dry cleaning wipe | 20–33% |
| Loading ratio | 2–4:1 |

wherein the ionic strength of the biocide release agent is at least about $2\times10^{-2}$ mol/l.

EXAMPLE 21

| | |
|---|---|
| BARQUAT 4250Z | 0.23–0.32% |
| Potassium Citrate | 0.1–0.88% |
| Disodium EDTA | 0.07–0.12% |
| Isopropanol | 2.7–4% |
| Barlox 12 | 0.155–0.32% |
| Water | at least 70% |
| DuPont 8838 | 20–22.2% |
| Loading ratio | 3.5–4:1 |

wherein the ionic strength of the salts in the improved cleaning composition is about $3.5\times10^{-2}$–$5\times10^{-2}$ mol/l.

EXAMPLE 22

| | |
|---|---|
| BARQUAT 4250Z | 0.25–0.45% |
| Potassium Citrate | 0.05–0.9% |
| Disodium EDTA | 0.05–0.15% |
| Isopropanol | 2.7–5% |
| Barlox 12 | 0.15–0.35% |

-continued

| | |
|---|---|
| Fragrance | 0.01–0.5% |
| Water | at least 70% |
| DuPont 8838 | 20–22.2% |
| Loading ratio | 3.5–4:1 |

wherein the ionic strength of the salts in the improved cleaning composition is about $3.5\times10^{-2}$–$5\times10^{-2}$ mol/l.

EXAMPLE 23

| | |
|---|---|
| BARQUAT 205M | 0.15–0.4% |
| Ammonium Chloride | 0.05–0.8% |
| Dipotassium EDTA | 0.07–0.12% |
| Isopropanol | 2.5–4% |
| PnB (glycol ether) | 0.05–2% |
| Surfonic L108 | 0.2–0.5% |

-continued

| | |
|---|---|
| Zonyl FSO | 0–1% |
| Fragrance | 0–2% |
| Water | at least 70% |
| DuPont 8838 | 20–22.2% |
| Loading ratio | 3.5–4:1 |
| pH | Alkaline |

wherein the ionic strength of the salts in the improved cleaning composition is about $3.5\times10^{-2}$–$5\times10^{-2}$ mol/l.

EXAMPLE 24

| | |
|---|---|
| Vantocil P | 0.1–0.5% |
| Isopropanol | 1.3–4% |
| PnB (glycol ether) | 0.35–1.5% |
| Surfactant | 0.15–1% |
| Ammonium Chloride | 0.03–1% |
| Dipotassium EDTA | 0–0.3% |
| Fragrance | 0–1% |
| Water | at least 70.6% |
| DuPont 8838 (wipe) | 15–30% |
| Loading ratio | 3–5:1 |
| pH | Alkaline |

wherein the ionic strength of the salts in the improved cleaning composition is about $3.5\times10^{-2}$–$5\times10^{-2}$ mol/l.

The inclusion of a cationic biocide release agent in the improved cleaning composition positively affects the cat-ionic biocide retention in a cleaning wipe. As illustrated in Table 1 below and in FIG. 1, the increase in salt content of the improved cleaning composition results in a decrease in quat retention and an increase in quat recovery. Similar results were obtained when biguanide compounds were included in the improved cleaning composition as illustrated in Table 2 and in FIG. 2.

For improved cleaning composition that included quat and were loaded on a cleaning wipe, several trials were conducted using two types of cleaning wipes and five different types of biocide release agents. The quat used in the improved cleaning composition was BARQUAT 4250Z by Lonza. The improved cleaning composition included about 0.37 weight percent biocide, about 0.3 weight percent amine oxide, about 0.1 weight percent sodium EDTA, 4.9 weight percent isopropanol, and the balance water. Each cleaning wipe had a loading ratio of improved cleaning composition to cleaning wipe of about 3.75:1. The results of the test are illustrated in Table 1.

TABLE 1

| | Quat Bactericidal Wipe Effective of Salts on Quat Released (Quat level = 0.29%) | | | | |
|---|---|---|---|---|---|
| % Salt | % Quat Recovery with K-Citrate (DuPont 8838) | % Quat Recovery with KCl (DuPont 8838) | % Quat Recovery with Na-Citrate (DuPont 8838) | % Quat Recovery with $MgSO_4$ (DuPont 8838) | % Quat Recovery with $NH_4Cl$ (Dexter ZA) |
| 0 | 52 | 51 | | | |
| 0.00304 | | | | | 67.4 |
| 0.00595 | | | | | 73.1 |
| 0.1013 | 57 | 60 | 59 | 71 | 75.9 |
| 0.304 | 75 | 69 | 73 | 79 | 82.1 |
| 0.697 | 88 | 77 | 90 | 91 | 82.4 |
| 1.0 | 98 | 86 | 89 | 96 | 96.3 |

For improved cleaning composition that included biguanide compounds and were loaded on a cleaning wipe, a single trial was conducted using Dexter 8589 for the cleaning wipe and Vantocil P(PHMB) by Avecia for the biguanide compound. The improved cleaning composition included about 0.3 weight percent biocide, about 0.5 weight percent APG (alkyl polyglycosides), 2.6 weight percent isopropanol, about 1 weight percent PnB, and the balance water. The cleaning wipe had a loading ratio of improved cleaning composition to cleaning wipe of about 3.75:1. The results of the test are illustrated in Table 2.

TABLE 2

| | Biguanide Bactericidal Wipe Effective of Salts on Biguanide Released (Biguanide level = 0.3%) |
|---|---|
| % Salt | % Biguanide Release with $NH_4Cl$ (Dexter 8589) |
| 0 | 35.9 |
| 0.1 | 42.7 |
| 0.3 | 46 |
| 0.4 | 59.1 |
| 0.5 | 62 |
| 0.6 | 68 |
| 0.7 | 77 |
| 0.8 | 88 |
| 0.9 | 92 |

Figure 2:
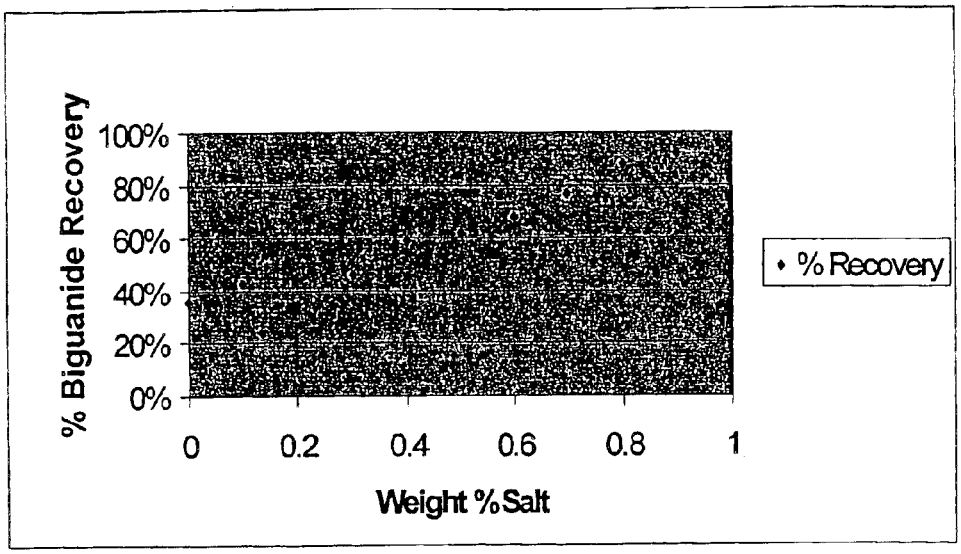

As illustrated in Tables 1 and 2, the quat and biguanide compound retention on the cleaning wipe is about 50% and 64% respectively when the salt was not added to the improved cleaning composition. The results in Tables 1 and 2 illustrate that the quat and biguanide compound retention is substantially reduced by increasing the concentration of salt in the improved cleaning composition. The variances in measured quat and biguanide compound retention are believed to be due to the type of cleaning wipe used, the ionic strength of the salt, and the chemical structure of the quat or biguanide compound. In every test, the inclusion of salt in the improved cleaning composition resulted in an increased quat and biguanide compound release from the cleaning wipe. FIG. 1 graphically illustrates the quat retention on a DuPont 8838 cleaning wipe as a function of the salt content of the improved cleaning composition. FIG. 2 graphically illustrates the biguanide compound retention on a Dexter 8589 cleaning wipe as a function of the salt content of the improved cleaning composition.

Another set of tests were conducted to determine if there was any effect on the quat release levels from the cleaning wipe as a function of the type of cleaning wipe. The results of these tests are illustrated in Table 3. The biocide used in the improved cleaning composition illustrated in Table 3 was BARQUAT 4250Z by Lonza. The improved cleaning composition included about 0.3 weight percent amine oxide, about 0.1 weight percent sodium EDTA, about 4.9 weight percent isopropanol, and the balance water. The biocide release agent used was potassium citrate. Two concentrations of potassium citrate were used, namely, 1.0 and 0.304 weight percent of the improved cleaning composition. The cleaning wipe was DuPont 8838 having a loading ratio of improved cleaning composition to cleaning wipe of about 3.75:1.

TABLE 3

Effect of Different Cleaning Wipes on Quat Released using K Citrate

| Cleaning Wipe | % Quat Released |
|---|---|
| Dexter 10180 (0.24% K Citrate) | 78 |
| Dexter M10201 (0.24% K Citrate) | 93 |
| Dexter ZA (0.24% K Citrate) | 83 |
| Dexter 10180 (0.79% K Citrate) | 100 |
| Dexter M10201 (0.79% K Citrate) | 100 |
| Dexter ZA (0.79% K Citrate) | 100 |

The test results in Table 3 reveal that an increase in quat release from the cleaning wipe occurred regardless of the type of wood pulp containing cleaning wipe. Similar results were observed from cleaning compositions containing biguanide compounds. In addition, the test results confirmed that increased salt concentrations in the improved cleaning composition resulted in decreased quat and biguanide compound retention.

Another set of tests were conducted to determine if there was any affect on the quat or biguanide compound release as a function of the amount of quat or biguanide compound in the improved cleaning composition. The results of these tests are illustrated in Table 4. The biocide used in the improved cleaning composition illustrated in Table 5 was BARQUAT 4250Z by Lonza. The improved cleaning composition included about 0.3 weight percent amine oxide, about 1 weight percent potassium citrate, about 0.1 weight percent sodium EDTA, about 4.9 weight percent isopropanol, and the balance water. The cleaning wipe was DuPont 8838 having a loading ratio of improved cleaning composition to cleaning wipe of about 3.75:1.

TABLE 4

Effect of different quat levels on quat released (K citrate = 1.0%)

| % Quat in Improved cleaning composition | % K-citrate = 1.0% |
|---|---|
| 0 | N/A |
| 0.507 | 100% |
| 0.101 | 99.6% |
| 0.203 | 95.8% |
| 0.279 | 94.2% |
| 0.367 | 95.2% |

The results in Table 4 indicate that the amount of quat compound release is not adversely affected by the amount of quat in the improved cleaning composition. Similar results were observed from cleaning compositions containing biguanide compounds.

Several tests were also conducted to determine whether the salt in the cleaning agent adversely affected the bactericidal efficacy of the improved cleaning composition containing quat and/or biguanide compound. In each test conducted, the salt did not adversely affect the bactericidal efficacy of the improved cleaning composition. In addition, it was found that the salts alone had little or no bactericidal efficacy.

Micro efficacy data was also obtained for an improved cleaning composition containing a quat and an improved cleaning composition containing a biguanide. These two formulations were compared to Lysol cleaner and Mr. Clean, both commercially available products. The results are set forth in Table 5.

TABLE 5

MICRO EFFICACY DATA

| | 30 Seconds Sanitizer Log Reduction | | 4 Minutes Disinfection Log Reduction | | | |
|---|---|---|---|---|---|---|
| | Staph | Kleb | Staph | *Pseudomonas* | *Salmonella* | Influenza A2 |
| Clorox B | 99.9% | 99.9% | 99.999% | 99.999% | 99.999% | 99.999% |
| Clorox Q | 99.9% | 99.9% | 99.999% | 99.999% | 99.999% | 99.999% |
| Mr. Clean* | — | — | — | — | 99.999% | — |
| Lysol* | 99.9% | 99.9% | 99.999% | 99.999% | 99.999% | 99.999% |

*The time period for Mr. Clean and Lysol was tested at 10 minutes.

The Clorox B formula is an improved cleaning composition that includes about 0.3 weight percent Vantocil P. The Clorox Q formula is an improved cleaning composition that includes about 0.4 weight percent BARQUAT 4250Z. The specific formulations of Clorox B and Clorox Q are set forth below:

| Clorox B | | Clorox O | |
|---|---|---|---|
| Vantocil P | 0.25–0.35% | Bardac 4250 | 0.3–0.5% |
| APG | 0.4–0.6% | Barlox 12 | 0.2–0.4% |
| Isopropanol | 2–3% | Isopropanol | 4.2–5.5% |
| PnB | 0.8–1.2% | DiNa EDTA | 0.05–0.2% |
| Ammonium Chloride | 0.1–0.5% | Potassium Citrate | 0.08–0.5% |
| Fragrance | 0.1–0.2% | Fragrance | 0.1–0.2% |
| Water | Balance | Water | Balance |
| DuPont 8838 | 20–22.2% | DuPont 8838 | 20–22.2% |
| Loading ratio | 3.5–4:1 | Loading ratio | 3.5–4:1 |

As illustrated in Table 5, both Clorox formulas exhibit excellent micro efficacy properties.

The invention has been described with reference to a preferred embodiment and alternates thereof. It is believed that many modifications and alterations to the embodiments disclosed will readily suggest itself to those skilled in the art upon reading and understanding the detailed description of the invention. It is intended to include all such modifications and alterations insofar as they come within the scope of the present invention.

We claim:

1. A method for cleaning a hard surface comprising:

a) providing an improved cleaning composition, said improved cleaning composition including a cationic biocide, a cationic biocide release agent which promotes release of said cationic biocide from an absorbent material, surfactant, solvent and water, said cationic biocide including a biguanide compound, said cationic biocide including about 0.05–5 weight percent of said cleaning composition, said cationic biocide release agent having an ionic strength in said improved cleaning composition of about $5\times10^{-3}$ mol/l to about 18 mol/l, said cationic biocide release agent including a salt selected from the group consisting of potassium citrate, sodium citrate, magnesium sulphate, sodium chloride, ammonium chloride or mixtures thereof, a majority of said solvent including a compound selected from the group consisting of methanol, ethanol, n-propanol, isopropanol, various positional isomers of butanol, pentanol, hexanol, glycol ether, acetone, PnB, DPnB, Hexyl Cellosolve or mixtures thereof, said water constituting a majority weight percent of said cleaning composition; and b) contacting said hard surface with said improved cleaning composition to at least partially disinfect, sanitize, or sterilize said surface.

2. The method as defined in claim 1, wherein said cationic biocide release agent has an ionic strength in said improved cleaning composition of about $1\times10^{-2}$ mol/l to about 5 mol/l.

3. The method as defined in claim 1, wherein said cationic biocide is about 0.05–0.5 weight percent of said cleaning composition.

4. The method as defined in claim 2, wherein said cationic biocide is about 0.05–0.5 weight percent of said cleaning composition.

5. The method as defined in claim 1, wherein said cleaning composition includes at least an effective amount of an organic solvent, said organic solvent is less than about 10 weight percent of said cleaning composition.

6. The method as defined in claim 4, wherein said cleaning composition includes at least an effective amount of an organic solvent, said organic solvent is less than about 10 weight percent of said cleaning composition.

7. The method as defined in claim 1, wherein said cleaning composition includes at least an effective amount of builder detergent, said builder detergent includes a compound selected from the group consisting of sodium EDTA, disodium EDTA, potassium EDTA, dipotassium EDTA or mixtures thereof.

8. The method as defined in claim 6, wherein said cleaning composition includes at least an effective amount of builder detergent, said builder detergent includes a compound selected from the group consisting of sodium EDTA, disodium EDTA, potassium EDTA, dipotassium EDTA or mixtures thereof.

9. The method as defined in claim 1, wherein said cleaning composition includes:

| | |
|---|---|
| Cationic Biocide | 0.1–1% |
| Biocide release agent | 0.1–2% |
| Builder detergent | 0–1% |
| Solvent | 0.1–5% |
| Surfactant | 0.1–4% |
| Water | at least 87% |

and the ionic strength of the biocide release agent is about $3\times10^{-2}$–0.4 mol/l.

10. The method as defined in claim 8, wherein said cleaning composition includes:

| | |
|---|---|
| Cationic Biocide | 0.1–1% |
| Biocide release agent | 0.1–2% |
| Builder detergent | 0–1% |
| Solvent | 0.1–5% |
| Surfactant | 0.1–4% |
| Water | at least 87% |

and the ionic strength of the biocide release agent is about $3\times10^{-2}$–0.4 mol/l.

11. The method as defined in claim 9, wherein said cleaning composition includes:

| | |
|---|---|
| Vantocil P | 0.1–0.5% |
| Isopropanol | 1.5–5% |
| Glycol ether | 0.5–2% |
| Surfactant | 0–1.5% |
| Ammonium Chloride | 0.05–1% |
| Dipotassium EDTA | 0–0.5% |
| Fragrance | 0–1% |
| Water | at least 89.5% |

and the ionic strength of the salts in the improved cleaning composition is about $3.5\times10^{-2}$–$5\times10^{-2}$ mol/l.

12. The method as defined in claim 10, wherein said cleaning composition includes:

| | |
|---|---|
| Vantocil P | 0.1–0.5% |
| Isopropanol | 1.5–5% |
| Glycol ether | 0.5–2% |

-continued

| | |
|---|---|
| Surfactant | 0–1.5% |
| Ammonium Chloride | 0.05–1% |
| Dipotassium EDTA | 0–0.5% |
| Fragrance | 0–1% |
| Water | at least 89.5% |

and the ionic strength of the salts in the improved cleaning composition is about $3.5\times10^{-2}$–$5\times10^{-2}$ mol/l.

13. The method as defined in claim 1, including the step of at least partially impregnating a material with said improved cleaning composition, said material having at least one layer of absorbent or adsorbent material, said absorbent or adsorbent material including wood pulp, wood pulp derivative or mixtures thereof.

14. The method as defined in claim 12, including the step of at least partially impregnating a material with said improved cleaning composition, said material having at least one layer of absorbent or adsorbent material, said absorbent or adsorbent material including wood pulp, wood pulp derivative or mixtures thereof.

15. The method as defined in claim 13, including the step of at least partially impregnating said material with said improved cleaning composition prior to contacting said hard surface.

16. The method as defined in claim 14, including the step of at least partially impregnating said material with said improved cleaning composition prior to contacting said hard surface.

17. A method for cleaning a hard surface comprising:

a) providing an improved cleaning composition, said improved cleaning composition including a cationic biocide, a cationic biocide release agent adapted to promote release of said cationic biocide from an absorbent material, surfactant, solvent, a builder detergent and water, said cationic biocide including a biguanide compound, said cationic biocide release agent having an ionic strength in said improved cleaning composition of about $5\times10^{-3}$ mol/l to about 18 mol/l, said cationic biocide release agent including a salt selected from the group consisting of potassium citrate, sodium citrate, magnesium sulphate, sodium chloride, ammonium chloride or mixtures thereof, a majority of said solvent including a compound selected from the group consisting of methanol, ethanol, n-propanol, isopropanol, various positional isomers of butanol, pentanol, hexanol, glycol ether, acetone, PnB, DPnB, Hexyl Cellosolve or mixtures thereof, said builder detergent including a compound selected from the group consisting of sodium EDTA, disodium EDTA, potassium EDTA, dipotassium EDTA or mixtures thereof, said water constituting a majority weight percent of said cleaning composition; and b) contacting said hard surface with said improved cleaning composition to at least partially disinfect, sanitize, or sterilize said surface.

18. The method as defined in claim 17, wherein said cationic biocide release agent has an ionic strength in said improved cleaning composition of about $1\times10^{-2}$ mol/l to about 5 mol/l.

19. The method as defined in claim 17, wherein said cationic biocide includes about 0.05–0.5 weight percent of said cleaning composition.

20. The method as defined in claim 18, wherein said cationic biocide includes about 0.05–0.5 weight percent of said cleaning composition.

21. The method as defined in claim 17, wherein said improved cleaning composition includes at least an effective amount of an organic solvent, said organic solvent is less than about 10 weight percent of said cleaning composition.

22. The method as defined in claim 20, wherein said improved cleaning composition includes at least an effective amount of an organic solvent, said organic solvent is less than about 10 weight percent of said cleaning composition.

23. The method as defined in claim 17, wherein said improved cleaning composition includes:

| | |
|---|---|
| Cationic Biocide | 0.1–1% |
| Biocide release agent | 0.1–2% |
| Builder detergent | 0–1% |
| Solvent | 0.1–5% |
| Surfactant | 0.1–4% |
| Water | at least 87% |

and the ionic strength of the biocide release agent is about $3\times10^{-2}$–0.4 mol/l.

24. The method as defined in claim 22, wherein said improved cleaning composition includes:

| | |
|---|---|
| Cationic Biocide | 0.1–1% |
| Biocide release agent | 0.1–2% |
| Builder detergent | 0–1% |
| Solvent | 0.1–5% |
| Surfactant | 0.1–4% |
| Water | at least 87% |

and the ionic strength of the biocide release agent is about $3\times10^{-2}$–0.4 mol/l.

25. The method as defined in claim 23, wherein said improved cleaning composition includes:

| | |
|---|---|
| Vantocil P | 0.1–0.5% |
| Isopropanol | 1.5–5% |
| Glycol ether | 0.5–2% |
| Surfactant | 0–1.5% |
| Ammonium Chloride | 0.05–1% |
| Dipotassium EDTA | 0–0.5% |
| Fragrance | 0–1% |
| Water | at least 89.5% |

and the ionic strength of the salts in the improved cleaning composition is about $3.5\times10^{-2}$–$5\times10^{-2}$ mol/l.

26. The method as defined in claim 24, wherein said improved cleaning composition includes:

| | |
|---|---|
| Vantocil P | 0.1–0.5% |
| Isopropanol | 1.5–5% |
| Glycol ether | 0.5–2% |
| Surfactant | 0–1.5% |
| Ammonium Chloride | 0.05–1% |
| Dipotassium EDTA | 0–0.5% |
| Fragrance | 0–1% |
| Water | at least 89.5% |

and the ionic strength of the salts in the improved cleaning composition is about $3.5\times10^{-2}$–$5\times10^{-2}$ mol/l.

27. The method as defined in claim 17, including the step of at least partially impregnating a material with said improved cleaning composition, said material having at least one layer of absorbent or adsorbent material, said absorbent or adsorbent material including wood pulp, wood pulp derivative or mixtures thereof.

28. The method as defined in claim 26, including the step of at least partially impregnating a material with said improved cleaning composition, said material having at least one layer of absorbent or adsorbent material, said absorbent or adsorbent material including wood pulp, wood pulp derivative or mixtures thereof.

29. The method as defined in claim 27, including the step of at least partially impregnating said material with said improved cleaning composition prior to contacting said hard surface.

30. The method as defined in claim 28, including the step of at least partially impregnating said material with said improved cleaning composition prior to contacting said hard surface.

31. A method for cleaning a surface with a cleaning wipe comprising:

a. providing a cleaning wipe having at least one layer of absorbent or adsorbent material, said cleaning wipe including a material selected from the group consisting of wood pulp, wood pulp derivative or mixtures thereof;

b. at least partially impregnating said cleaning wipe with an improved cleaning composition including a cationic biocide, a cationic biocide release agent to promote release of said cationic biocide from said absorbent or adsorbent material, surfactant, solvent and water, said cationic biocide including a biguanide compound, said cationic biocide release agent having an ionic strength in said improved cleaning composition of about $5\times10^{-3}$ mol/l to about 18 mol/l, said cationic biocide constituting about 0.05–5 weight percent of said cleaning composition, said water constituting a majority weight percent of said cleaning composition, said cationic biocide release agent including a salt selected from the group consisting of potassium citrate, sodium citrate, magnesium sulphate, sodium chloride, ammonium chloride or mixtures thereof, a majority of said solvent including a compound selected from the group consisting of methanol, ethanol, n-propanol, isopropanol, various positional isomers of butanol, pentanol, hexanol, glycol ether, acetone, PnB, DPnB, Hexyl Cellosolve or mixtures thereof, said water constituting a majority weight percent of said cleaning composition; and c. contacting said surface with the cleaning wipe to at least partially disinfect, sanitize, or sterilize said surface.

32. The method as defined in claim 31, wherein said cationic biocide includes a biguanide compound.

33. The method as defined in claim 32, wherein said cationic biocide includes a quaternary ammonium compound.

34. The method as defined in claim 31, wherein said cationic biocide release agent reduces the cationic biocide retention on said wipe to less than about 30%.

35. The method as defined in claim 32, wherein said cationic biocide release agent reduces the cationic biocide retention on said wipe to less than about 30%.

36. The method as defined in claim 33, wherein said cationic biocide release agent reduces the cationic biocide retention on said wipe to less than about 30%.

37. The method as defined in claim 31, wherein said cationic biocide release agent has an ionic strength of about $2\times10^{-2}$ mol/l to about 1 mol/l.

38. The method as defined in claim 35, wherein said cationic biocide release agent has an ionic strength of about $2\times10^{-2}$ mol/l to about 1 mol/l.

39. The method as defined in claim 36, wherein said cationic biocide release agent has an ionic strength of about $2\times10^{-2}$ mol/l to about 1 mol/l.

40. The method as defined in claim 31, wherein said surfactant is up to about 5 weight percent of said cleaning composition and includes a compound selected from the group consisting of lauryl sulfate, laurylether sulfate, cocamidopropylbetaine, alkyl polyglycoside, amine oxide or mixtures thereof.

41. The method as defined in claim 35, wherein said surfactant is up to about 5 weight percent of said cleaning composition and includes a compound selected from the group consisting of lauryl sulfate, laurylether sulfate, cocamidopropylbetaine, alkyl polyglycoside, amine oxide or mixtures thereof.

42. The method as defined in claim 39, wherein said surfactant is up to about 5 weight percent of said cleaning composition and includes a compound selected from the group consisting of lauryl sulfate, laurylether sulfate, cocamidopropylbetaine, alkyl polyglycoside, amine oxide or mixtures thereof.

43. The method as defined in claim 31, wherein said solvent constitutes up to about 5 weight percent of said cleaning composition and includes a compound selected from the group consisting of methanol, ethanol, n-propanol, isopropanol, various positional isomers of butanol, pentanol, hexanol or mixtures thereof.

44. The method as defined in claim 41, wherein said solvent constitutes up to about 5 weight percent of said cleaning composition and includes a compound selected from the group consisting of methanol, ethanol, n-propanol, isopropanol, various positional isomers of butanol, pentanol, hexanol or mixtures thereof.

45. The method as defined in claim 42, wherein said solvent constitutes up to about 5 weight percent of said cleaning composition and includes a compound selected from the group consisting of methanol, ethanol, n-propanol, isopropanol, various positional isomers of butanol, pentanol, hexanol or mixtures thereof.

46. The method as defined in claim 31, wherein said cleaning composition includes about 0.05–0.5 weight percent builder detergent, said builder detergent includes a compound selected from the group consisting of sodium EDTA, disodium EDTA, potassium EDTA, dipotassium EDTA or mixtures thereof.

47. The method as defined in claim 44, wherein said cleaning composition includes about 0.05–0.5 weight percent builder detergent, said builder detergent includes a compound selected from the group consisting of sodium EDTA, disodium EDTA, potassium EDTA, dipotassium EDTA or mixtures thereof.

48. The method as defined in claim 45, wherein said cleaning composition includes about 0.05–0.5 weight percent builder detergent, said builder detergent includes a compound selected from the group consisting of sodium EDTA, disodium EDTA, potassium EDTA, dipotassium EDTA or mixtures thereof.

49. The method as defined in claim 31, wherein said water constitutes at least about 80 weight percent of said cleaning composition.

50. The method as defined in claim 47, wherein said water constitutes at least about 80 weight percent of said cleaning composition.

51. The method as defined in claim 48, wherein said water constitutes at least about 80 weight percent of said cleaning composition.

52. The method as defined in claim 31, wherein said cleaning composition includes:

| | |
|---|---|
| Cationic Biocide | 0.067–0.8% |
| Solvent | 0.067–4% |
| Surfactant | 0–3.2% |
| Builder detergent | 0–0.8% |
| Biocide release agent | up to 1.6% |
| Water | at least 58% |
| Dry cleaning wipe | 15–33% |
| Loading ratio | 2–5:1 |

and the ionic strength of the biocide release agent is about $3\times10^{-2}$–0.4 mol/l.

53. The method as defined in claim 50, wherein said cleaning composition includes:

| | |
|---|---|
| Cationic Biocide | 0.067–0.8% |
| Solvent | 0.067–4% |
| Surfactant | 0–3.2% |
| Builder detergent | 0–0.8% |
| Biocide release agent | up to 1.6% |
| Water | at least 58% |
| Dry cleaning wipe | 15–33% |
| Loading ratio | 2–5:1 |

and the ionic strength of the biocide release agent is about $3\times10^{-2}$–0.4 mol/l.

54. The method as defined in claim 51, wherein said cleaning composition includes:

| | |
|---|---|
| Cationic Biocide | 0.067–0.8% |
| Solvent | 0.067–4% |
| Surfactant | 0–3.2% |
| Builder detergent | 0–0.8% |
| Biocide release agent | up to 1.6% |
| Water | at least 58% |
| Dry cleaning wipe | 15–33% |
| Loading ratio | 2–5:1 |

and the ionic strength of the biocide release agent is about $3\times10^{-2}$–0.4 mol/l.

55. The method as defined in claim 52, wherein said cleaning composition includes:

| | |
|---|---|
| Cationic Biocide | 0.1–1% |
| Biocide release agent | 0.1–2% |
| Builder detergent | 0–1% |
| Solvent | 0.1–5% |
| Surfactant | 0.1–4% |
| Water | at least 87% |

and the ionic strength of the biocide release agent is about $3\times10^{-2}$–0.4 mol/l.

56. The method as defined in claim 53, wherein said cleaning composition includes:

| | |
|---|---|
| Cationic Biocide | 0.1–1% |
| Biocide release agent | 0.1–2% |
| Builder detergent | 0–1% |
| Solvent | 0.1–5% |
| Surfactant | 0.1–4% |
| Water | at least 87% |

and the ionic strength of the biocide release agent is about $3\times10^{-2}$–0.4 mol/l.

57. The method as defined in claim 54, wherein said cleaning composition includes:

| | |
|---|---|
| Cationic Biocide | 0.1–1% |
| Biocide release agent | 0.1–2% |
| Builder detergent | 0–1% |
| Solvent | 0.1–5% |
| Surfactant | 0.1–4% |
| Water | at least 87% |

and the ionic strength of the biocide release agent is about $3\times10^{-2}$–0.4 mol/l.

58. The method as defined in claim 55, wherein said cleaning composition includes:

| | |
|---|---|
| Vantocil P | 0.1–0.5% |
| Isopropanol | 1.3–4% |
| Glycol ether | 0.35–1.5% |
| Surfactant | 0.15–1% |
| Ammonium Chloride | 0.03–1% |
| Dipotassium EDTA | 0–0.3% |
| Fragrance | 0–1% |
| Water | at least 70.6% |
| DuPont 8838 (wipe) | 15–30% |
| Loading ratio | 3–5:1 |

and the ionic strength of the salts in the improved cleaning composition is about $3.5\times10^{-2}$–$5\times10^{-2}$ mol/l.

59. The method as defined in claim 56, wherein said cleaning composition includes:

| | |
|---|---|
| Vantocil P | 0.1–0.5% |
| Isopropanol | 1.3–4% |
| Glycol ether | 0.35–1.5% |
| Surfactant | 0.15–1% |
| Ammonium Chloride | 0.03–1% |
| Dipotassium EDTA | 0–0.3% |
| Fragrance | 0–1% |
| Water | at least 70.6% |
| DuPont 8838 (wipe) | 15–30% |
| Loading ratio | 3–5:1 |

and the ionic strength of the salts in the improved cleaning composition is about $3.5\times10^{-2}$–$5\times10^{-2}$ mol/l.

60. The method as defined in claim 57, wherein said cleaning composition includes:

| | |
|---|---|
| Vantocil P | 0.1–0.5% |
| Isopropanol | 1.3–4% |
| Glycol ether | 0.35–1.5% |
| Surfactant | 0.15–1% |
| Ammonium Chloride | 0.03–1% |
| Dipotassium EDTA | 0–0.3% |
| Fragrance | 0–1% |
| Water | at least 70.6% |
| DuPont 8838 (wipe) | 15–30% |
| Loading ratio | 3–5:1 |

and the ionic strength of the salts in the improved cleaning composition is about $3.5\times10^{-2}$–$5\times10^{-2}$ mol/l.

* * * * *